US009440767B2

(12) United States Patent
Vanderstraeten

(10) Patent No.: US 9,440,767 B2
(45) Date of Patent: Sep. 13, 2016

(54) RECLOSING CAN FOR FOOD PRODUCT

(75) Inventor: Erwin Vanderstraeten, Gentbrugge (BE)

(73) Assignee: E.V.D.S. BVBA, Gentbrugge (BE)

( * ) Notice: Subject to any disclaimer, the term of this patent is extended or adjusted under 35 U.S.C. 154(b) by 462 days.

(21) Appl. No.: 13/820,185

(22) PCT Filed: Sep. 1, 2011

(86) PCT No.: PCT/EP2011/065143

§ 371 (c)(1),
(2), (4) Date: Mar. 1, 2013

(87) PCT Pub. No.: WO2012/028694

PCT Pub. Date: Mar. 8, 2012

(65) Prior Publication Data

US 2013/0161325 A1 Jun. 27, 2013

Related U.S. Application Data

(63) Continuation of application No. PCT/EP2011/054248, filed on Mar. 21, 2011, which is a continuation of application No. PCT/EP2011/052078, filed on Feb. 11, 2011.

(60) Provisional application No. 61/508,195, filed on Jul. 15, 2011.

(30) Foreign Application Priority Data

Sep. 1, 2010 (EP) ..... 10174888

(51) Int. Cl.
*B65D 51/18* (2006.01)
*B65D 17/32* (2006.01)
(Continued)

(52) U.S. Cl.
CPC ..... *B65D 17/166* (2013.01); *B21D 51/2653* (2013.01); *B65B 7/16* (2013.01);
(Continued)

(58) Field of Classification Search
USPC ..... 220/257.2, 271, 270, 269, 257.1, 712, 220/203.19, 203.22, 202, 203.01, 203.07, 220/203.1, 203.11, 262, 714, 203.04, 254.3, 220/254.4, 849; 215/251, 260
See application file for complete search history.

(56) References Cited

U.S. PATENT DOCUMENTS 4,190,174 A 2/1980 Haimowitz
4,361,249 A 11/1982 Tuneski et al.
(Continued)

FOREIGN PATENT DOCUMENTS

CN 1053403 A 7/1991
EP 2157023 A1 2/2010
(Continued)

OTHER PUBLICATIONS

Australian Office Action dated Mar. 28, 2014, for AU 2011298346.
(Continued)

*Primary Examiner* — J. Gregory Pickett
*Assistant Examiner* — Allan Stevens
(74) *Attorney, Agent, or Firm* — Bacon & Thomas, PLLC

(57) ABSTRACT

A can end (2) is described for a metal beverage can, optionally for carbonated drinks, the can end including a cap top (3), arranged in connection to a pull tab (4) configured to remove the cap top along a pre-defined groove (9), to thereby create a drinking or pouring aperture; an elastic resilient element (10) attached to the can end; and a resiliently operated shut-off valve (6) that is part of or is connected to the elastic resilient element (10) and that is configured to seal the drinking or pouring aperture after drinking or pouring; wherein the cap top (3) is configured to remain located, after the removal, on top of the shut-off valve (6). Further, a can including such a can end, and a method for opening and reclosing such a can are described, as well as a method for producing such a can.

16 Claims, 40 Drawing Sheets

(51) Int. Cl.

| | |
|---|---|
| ***B65D 17/00*** | (2006.01) |
| ***B65D 51/22*** | (2006.01) |
| ***B21D 51/26*** | (2006.01) |
| ***B65B 7/16*** | (2006.01) |

(52) U.S. Cl.
CPC ..... *B65D 51/22* (2013.01); *B65D 2517/0014* (2013.01); *B65D 2517/0028* (2013.01); *B65D 2517/0044* (2013.01); *B65D 2517/0094* (2013.01)

(56) References Cited

U.S. PATENT DOCUMENTS

| | | | | |
|---|---|---|---|---|
| 4,747,511 | A | 5/1988 | Dutt et al. | |
| 4,784,283 | A | 11/1988 | Cantu | |
| 5,810,189 | A | 9/1998 | Baker | |
| 2006/0289540 | A1 | 12/2006 | Lee | |
| 2008/0314904 | A1 | 12/2008 | Perra | |
| 2009/0206083 | A1 | 8/2009 | Heigl | |
| 2012/0248113 | A1* | 10/2012 | Majcen et al. ..... | 220/269 |

FOREIGN PATENT DOCUMENTS

| | | | |
|---|---|---|---|
| JP | H09-39962 | A | 2/1997 |
| JP | 2008-546610 | A | 12/2008 |
| WO | 2007/147542 | A1 | 12/2007 |

OTHER PUBLICATIONS

Chinese Office Action dated Aug. 27, 2014, for CN 201180041912.8, and English abstract thereof.
European Search Report in EP 10 17 4888, dated Jan. 6, 2011.
International Search Report in PCT/EP2011/052078, dated Jul. 20, 2011.
International Search Report in PCT/EP2011/054248, dated Oct. 31, 2011.
International Search Report and 1st Written Opinion for PCT/EP2011/065143, Jan. 30, 2012.
International Preliminary Report on Patentability & Response to 1st Written Opinion (w/ annexed claims) for PCT/EP2011/065143, Feb. 13, 2013.
Second Chinese Office Action dated Apr. 24, 2015, for CN 201180041912.8, and English abstract thereof.
Japanese Office Action dated Nov. 17, 2015, for JP 2013-526479, and English abstract thereof.

* cited by examiner

RECLOSING CAN FOR FOOD PRODUCT

FIELD OF THE INVENTION

The present invention relates to a container such as a can for a food product, especially a beverage, as well as a method of manufacturing the container or can. The container or can is especially suitable for carbonated beverages or drinks. The container or can can be provided with means for easily reclosing after the first opening.

BACKGROUND TO THE INVENTION

Metal beverage cans usually have a pull tab (working as a lever mechanism) to allow for the opening of the can along a pre-determined shallow groove. This design allows venting the excess pressure in the can when it is opened. As the tab is lifted, first a vent score is severed, allowing the gases in the can to be released, and then the aperture score is ruptured, which defines an aperture through which the contents of the beverage can may be dispensed. The groove has the shape of a non-closed loop, so that when pressure is applied by the lever to rip the metal along the groove, the metal tab that is ripped off remains attached to the top of the can, even when the lever is returned to its original position.

With existing cans, a permanent opening is formed by these manipulations, so that the contents of the can may be drunk, but on the other hand carbon dioxide may escape and spills may occur.

Patents U.S. Pat. No. 4,784,283 and U.S. Pat. No. 5,810,189 disclose beverage cans that include a spring-loaded tab inside the can that is configured to reclose the drinking aperture after the can is opened for the first time. However, for a carbonated beverage can, pressure is built up in the can because of the gases. The pressure decreases as the amount of liquid in the can decreases, but the pressure can be quite high initially: depending on the temperature of the liquid, this pressure can be between 3 and 4 bar. Such a high pressure on a closing surface of e.g. 2.5 to 3.5 $cm^2$ results in a large force that needs to be counteracted when opening the can for drinking when the can still contains a large amount of beverage.

Patent application US 2008/0314904, with inventor Perra, discloses a closing device for a food product container, more particularly a drink container, that includes a wall part provided with an opening and a shield member sealing the opening. The shield member is displaceable between a first, closed position sealing the opening in the wall part and a second, opened position leaving the opening at least partly open. The shield member is provided with a locking member securing the shield member in the first, closed position, and the shield member oriented in the first, closed position can be unlocked by displacing a locking member. The operations of unlocking and opening a (drinking) opening are separated such that both operations can be optimized independently of each other. The food product container can be used for carbonated drinks, such as sparkling water. In this case, pressure is built up in the drink container because of the gases. In an embodiment, a closing device with a gas passage is disclosed that acts as a relief valve to decrease pressure in the drink container when it is opened for the first time. Instead of for carbonated beverages, the food product container can also be used for other food articles, such as for example non-carbonated beverages, instant soup, instant coffee, oil, honey, sauces, dairy products such as milk or yoghurt, et cetera.

Patent application WO 2007/147542 A1 discloses a closing device for beverage cans, wherein the device comprises an opening tab provided in a wall of the beverage can, an opening element for pressing the opening tab inwards, and a fixing device for detachably fixing the opening tab to said wall of the beverage can.

SUMMARY OF THE INVENTION

The present invention provides an alternative container, e.g. a can for food products, especially beverages such as carbonated drinks. An advantage of embodiments of the container or can is that it is provided with means for easily reclosing after it is opened for the first time. Thus, spilling food or liquid is avoided. In some embodiments the reclosing is not only liquid tight but also gas tight. In case of a carbonated drink, the carbon dioxide will then not escape from the can as is the case with a traditional can, since the can according to the present invention is reclosed.

The present invention provides in one embodiment a can end for a metal beverage can optionally for carbonated drinks, the can end comprising:

- a cap top, arranged in connection to a pull tab configured to remove the cap top from the can end along a pre-defined groove, to thereby create a drinking or pouring aperture;
- an elastic resilient element attached to the can end;
- a resiliently operated shut-off valve that is part of or is connected to the elastic resilient element and that is configured to close and seal the drinking or pouring aperture after drinking or pouring, by an action of said elastic resilient element;

wherein the cap top is configured to remain located, after the removal, on top of the shut-off valve.

The elastic resilient element may have holding means for holding the shut-off valve in an opened position upon moving the cap top.

The present invention also includes a metal beverage can optionally for carbonated drinks comprising a can body and a can end in accordance with the invention.

The present invention further includes a method for producing a can, embodiments of the method comprising producing a can end in accordance with the invention, producing a can body, and attaching the can end to the can body.

Embodiments of the present invention also include a method for using a reclosing metal beverage can, optionally for carbonated drinks, said can comprising a can body and a can end, the method comprising the steps of:

- actuating a pull tab of said can end, thus removing a cap top of said can end along a predetermined groove of said can end, thus creating a drinking or pouring aperture;

resiliently opening, by said actuating said pull tab, a shut-off valve that is part of or is connected to an elastic resilient element of said can end and that is configured to close and seal said drinking or pouring aperture after drinking or pouring, by an action of said elastic resilient element (10), wherein said removed cap top remains located on top of said shut-off valve.

The method may further comprise holding said shut-off valve in an opened position by said elastic resilient element.

In a preferred embodiment, the container or can includes a can end, the can end comprising a cap top, arranged in connection to a pull tab configured to remove the cap top along a pre-defined groove or other form of mechanical weakness, to thereby create a drinking aperture. The can end preferably comprises a resiliently operated, e.g. spring operated shut-off valve configured to open the drinking aperture during drinking and to seal the drinking opening when the can is not in use. The sealing may be a liquid and/or gas tight sealing. The cap top is preferably configured to remain located, after the removal, on top of the shut-off valve. Preferably, the can end comprises an elastic resilient element attached to the can end, that has holding means for holding the shut-off valve in an opened position upon moving the cap top.

Moving the cap top, so that it can be held in an opened position, may be done in different ways. The cap top may be moved by moving the pull tab. In one embodiment, the cap top comprises a raised lip-contact portion on its upper surface, and the cap top may then be moved by moving said raised lip-contact portion. The cap top may also be moved by a finger of the user.

In one preferred embodiment, the shut-off valve includes a relief valve, optionally actuatable by interaction with the cap top and e.g. configured to release gas pressure from inside the can, upon the first pressure exerted on the relief valve.

Preferred embodiments of the container or can according to the present invention are suitable for mass production.

One advantage of some embodiments of the invention, when used for carbonated beverages, is that means may be provided for relieving the internal pressure in the can. In a carbonated beverage can, pressure is built up in the can because of the gases. In some embodiments of the invention, when the can is being opened for the second or for a subsequent time, the internal pressure is relieved before reopening, so that the can can be reopened easily since no large force needs to be counteracted.

Another advantage of some embodiments in accordance with the invention is a security pressure relief. When an already opened can that contains a carbonated beverage is reclosed, pressure builds up underneath the can end. As the drinking opening has already been created, the strength of the can end has significantly decreased, and the can end may gradually deform under the built up pressure. Such a deformation causes the can end to bulge outwards. Especially in high temperatures (e.g. when the can is in the sun in a car) this effect may become important and there may be a risk of rupture of the can. In some embodiments of the invention, a security pressure relief then decreases pressure before it becomes too high, and thus makes sure that a can that contains a carbonated beverage will not be ruptured and will not explode.

Yet another advantage of some embodiments of cans in accordance with the invention is that they are spilling-proof: when they are tipped over or are dropped, they are closed automatically.

Further, some embodiments of cans according to the invention may be reclosed easily and in different ways, depending on the size and type of the can. Some types of cans may be closed by gently pushing against a side wall of the can. Types of cans may be closed by gently tapping against the can, e.g. by putting the can on a table with a small shock.

Another, important advantage of a container or can according to the invention is that it can easily be produced. In comparison with a traditional can, only the can end is different. Thus, a traditional production line of cans can be modified to produce the container or can, e.g. by replacing the production steps for the traditional can end by the production steps for the can end according to the invention; e.g. by adaptation of the tooling for the production line. The production steps and tooling for the can body and for attaching the can end to the can body can remain unchanged. Moreover, a can end in accordance with the invention requires only a small number of parts. In some embodiments in accordance with the invention, the elastic resilient element has dimensions and properties such that the can ends, each including an elastic resilient element, are stackable. The can ends may thus be stacked one on top of the other, so that a stack of can ends requires only little space, just as stacked can ends of traditional cans do.

The container or can will be described below especially when used for beverages, particularly carbonated drinks. It will be clear from the description however that the can may also be used for other food products, such as instant soup, instant coffee, oil, honey, sauces, dairy products such as milk or yoghurt, et cetera.

BRIEF DESCRIPTION OF THE DRAWINGS

The invention will be described, by way of example only, with reference to the accompanying drawings, wherein:

FIGS. 4 to 10 are views of an embodiment of a can end and the top portion of a can wherein the front half is cut away, and in which:

FIGS. 4 and 5 show the first opening of a can;

FIGS. 7 and 8 show reclosing of a can;

DETAILED DESCRIPTION OF PREFERRED EMBODIMENTS OF THE INVENTION

Figure 1A:
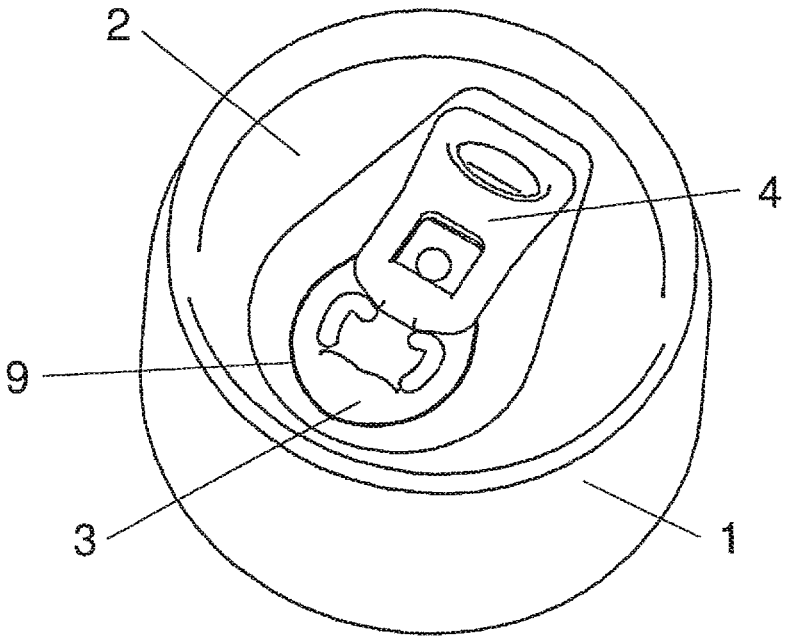
FIGS. 1*a* and 1*b* show 3D views of an embodiment of a can end and the top portion of a can, seen respectively from the top and from the bottom.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

FIG. 1*a* shows a 3D view of the top portion of a container or can, e.g. a re-sealable beverage can in accordance with an embodiment of the present invention. The can includes a can body 1 and a can end 2 attached to the body. The can body may be a standard can body, typically made out of steel, or out of aluminum. The can end is often produced in aluminum. None of these materials represent a limitation to the invention, e.g. the can end 2 in accordance with the invention may be made from steel. If steel is used, for the can body 1, the can end 2 or for both, it is customarily coated. The invention may be applied to different standard containers such as beverage cans and sizes, as well as to so-called "slim" and "super sized" cans. FIG. 1*a* shows a "slim sized" can, with a so-called small drinking opening. A standard can with a large drinking opening is shown and discussed further below. Other designs of openings such as drinking or pouring openings may be used as well. In an embodiment, the edge of the can end 2 is standard, especially the way it has to be assembled on the can body 1 after filling with the food product.

Figure 1B:
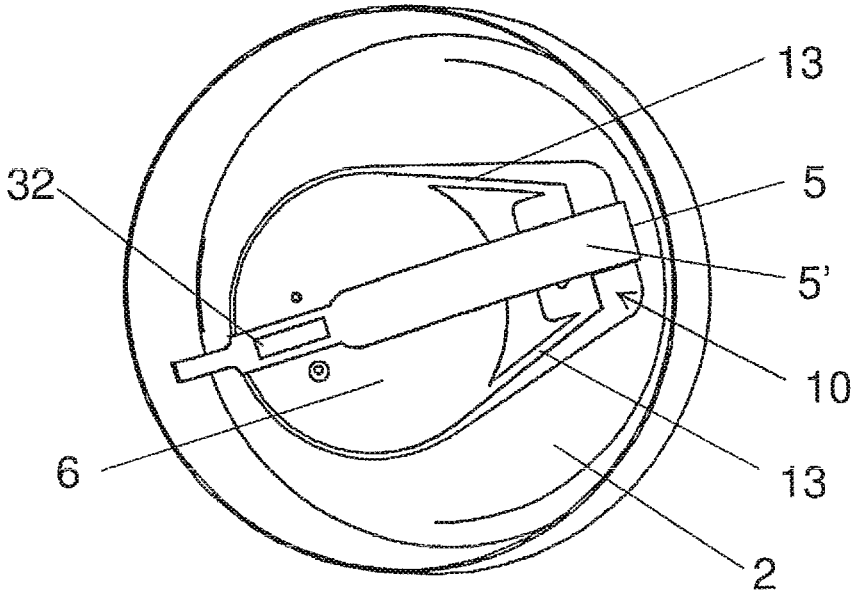

In the embodiment shown in FIGS. 1*a* and 1*b*, the central part of the can end 2 has a tear panel 3, called the cap top in this document, which is very similar to the pull-off part of a standard beverage can end. As in a known, traditional beverage can, the cap top 3 can be torn off along the pre-formed shallow groove 9 or other form of mechanical weakness, by pulling at the pull tab 4, which works as a lever. The opening that is thus created serves as a pouring or drinking opening, as in a traditional beverage can. However, in a traditional beverage can the cap top remains attached to the can, whereas in the disclosed embodiment according to the invention the cap top 3 is torn completely from the can end along the groove 9. After tearing off the cap top 3, the cap top 3 remains attached to a shut-off valve 6 (shown in FIG. 1*b*), which is configured to reseal the pouring or drinking opening after drinking, by the action of an elastic resilient element 10, which is described in detail further below. In the shown embodiment, before it is opened for the first time, the can is closed in the same way as a traditional can. It is opened by making a rupture through metal, as is the case for a traditional can, and it is thus as leak-proof as a traditional can. Many other existing re-sealable cans rely on other opening mechanisms, e.g. on opening by a rotation, and they are often not at all as leak-proof.

In an embodiment, the shut-off valve 6 is a plate-like element, which is resiliently biased, e.g. spring-biased against the underside of the can end 2, by the resilient force, e.g. spring force, exerted by a resilient member such as a spring means 5 being part of elastic resilient element 10, and further, possibly, by any force resulting from the internal pressure that is built up when the can is filled with a carbonated drink. The shut-off valve may be round, it may be oval, it may have another shape. The shut-off valve 6 may be provided with a relief valve. Different embodiments of this relief valve are disclosed further below.

Figure 4:
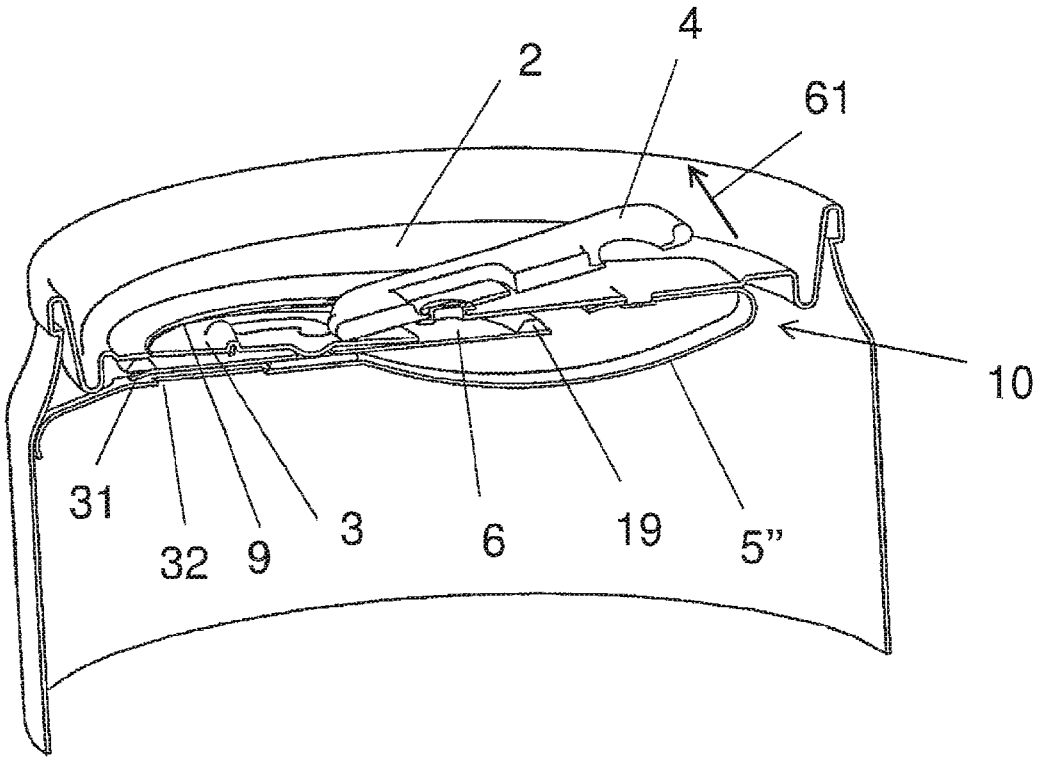
Figure 5:
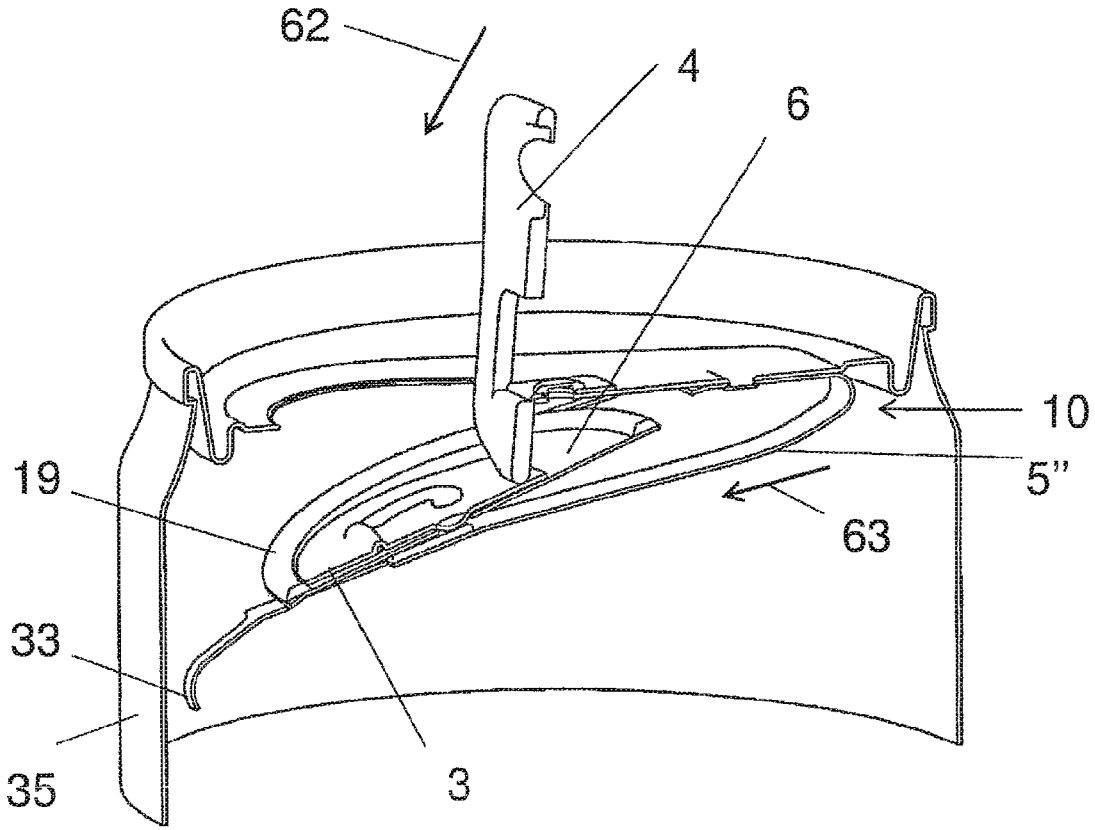
Figure 6A:
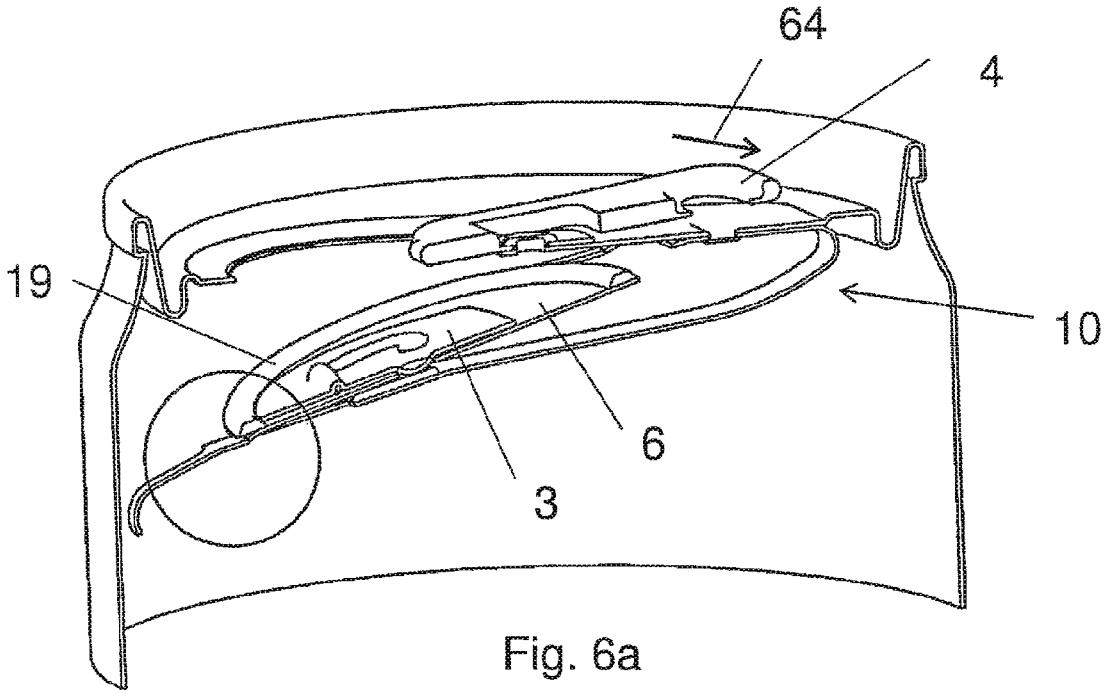
FIGS. 6*a* and 6*b* show a can ready for drinking.
Figure 6B:
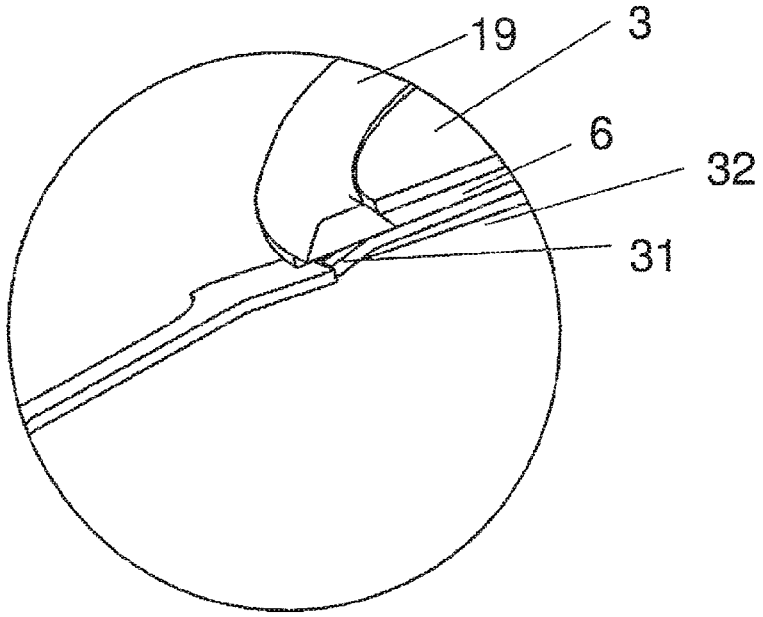

In the embodiment shown in FIGS. 1*a* and 1*b*, the consumer can drink or pour from the can by tearing open the cap top 3 by actuating the pull tab 4, as explained above; when moving the pull tab 4 further, the shut-off valve 6 is held in an opened position so that the consumer can drink or pour. This is explained in detail further below, with reference to FIGS. 4-6; FIGS. 4 and 5 illustrate the first opening of the can, while FIGS. 6*a* and 6*b* show the can ready for drinking. FIG. 6*a* shows a side view of an embodiment of a can, while FIG. 6*b* shows a detail of the area indicated in FIG. 6*a*. In FIG. 6*a*, the cap top 3, and hence the shut-off valve 6 below the cap top, was pushed downwards by actuating pull tab 4, against the force of the elastic resilient element 10. In FIG. 6*a*, pull tab 4 is now being put back in its original position, as indicated by arrow 64. Shut-off valve 6 is held in an opened position by holding means 32 of elastic resilient element 10; in the embodiment of FIGS. 6*a* and 6*b*, this holding means 32 is a slit engaging with an engaging element 31 of shut-off valve 6, which is in this embodiment a slightly downwards bent hook, and thus holding the valve.

Figure 2A:
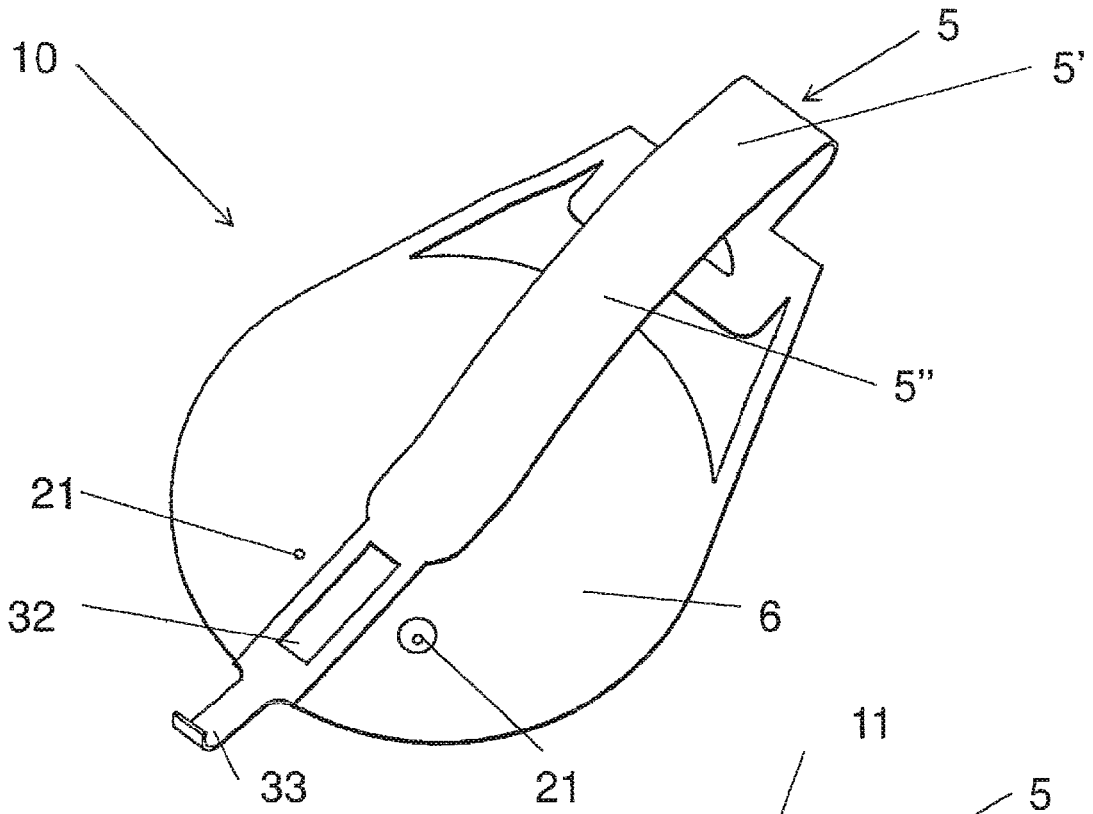
FIGS. 2*a* and 2*b* show views of an embodiment of an elastic resilient element.
Figure 2B:
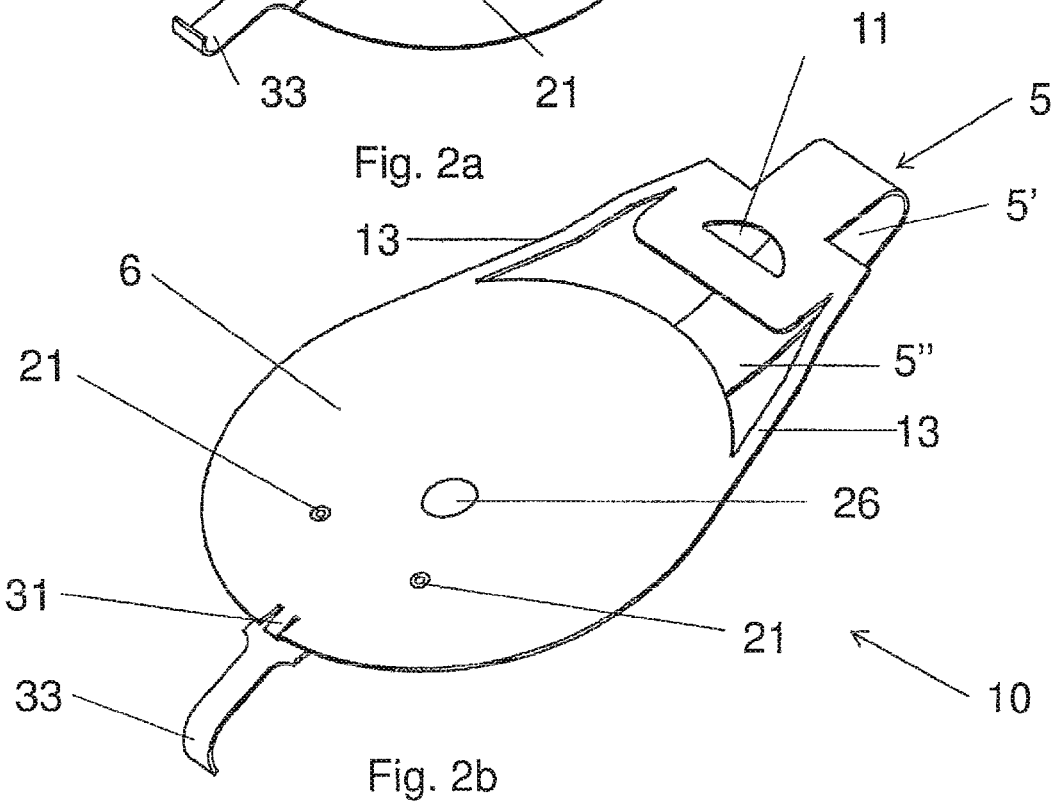
Figure 3A:
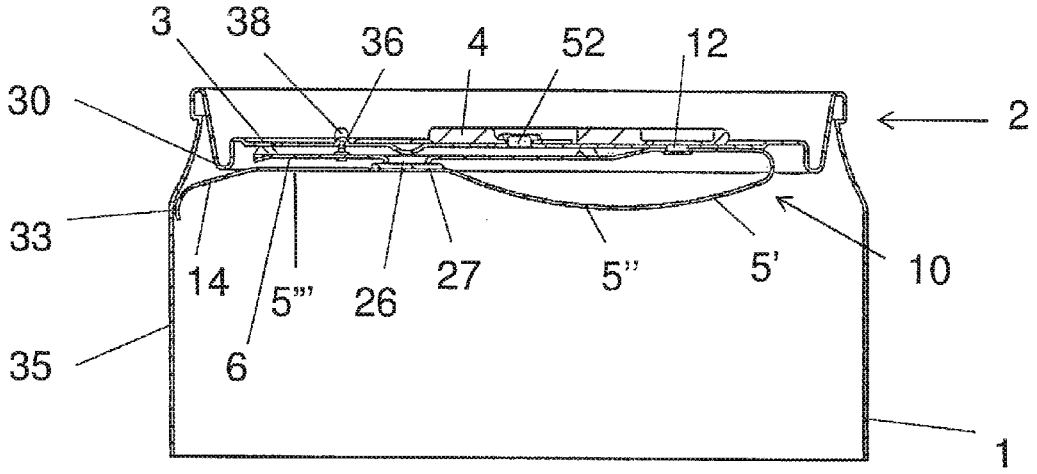
FIG. 3*a* shows a cross section along line A-A in FIG. 3*b;*
Figure 3B:
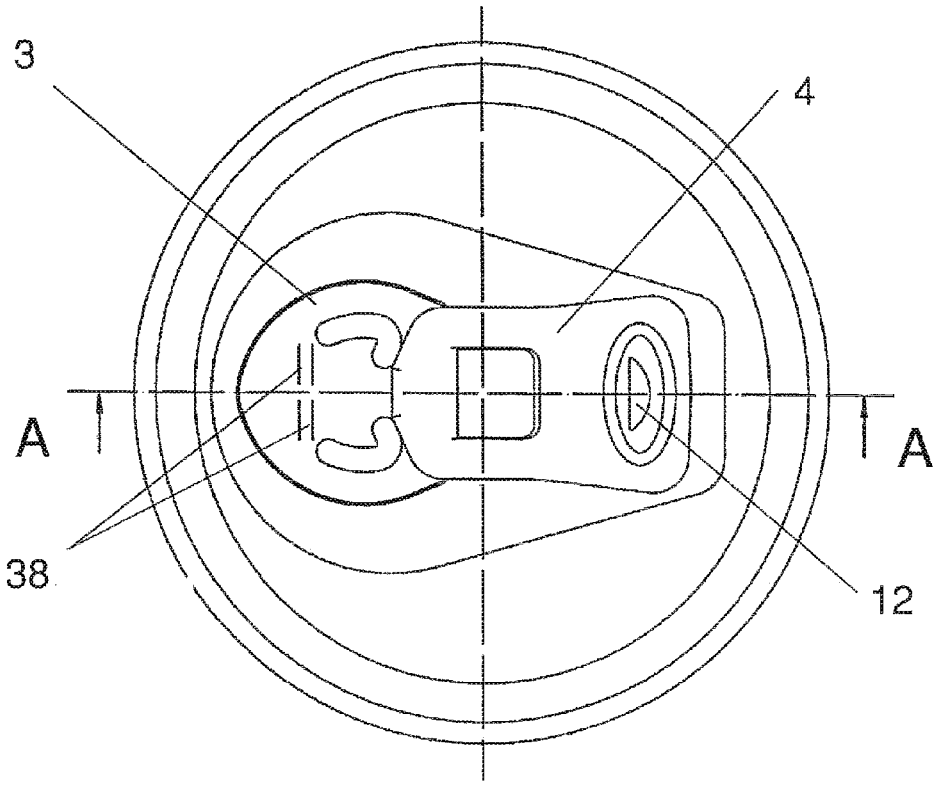
FIG. 3*b* shows a top view of an embodiment of a can end and the top portion of a can, before its first opening.

In the embodiment of FIGS. 1*a* and 1*b*, the elastic resilient element 10 comprises spring means 5. This embodiment of the elastic resilient element 10 is shown in detail in FIGS. 2*a* and 2*b*, which show respectively a bottom view and a top view of the elastic resilient element 10, and element 10 is further shown in FIG. 3*a*, which is a cross section of a top portion of a can. In this embodiment, the elastic resilient element 10 comprises spring means 5, and the shut-off valve 6 is part of the elastic resilient element 10. In other embodiments of the invention, the shut-off valve 6 may be a separate element, connected to the elastic resilient element. The elastic resilient element, and the shut-off valve if it is not part of the elastic resilient element, may be made e.g. from HSS (High Strength Steel), which has fairly good resilience, combined with good mechanical properties for stamping and distortion. In some embodiments, the elastic resilient element may comprise a plurality of parts. In the embodiment of FIGS. 1-3, the elastic resilient element 10 is a single part, and is a specially designed plate element. The elastic resilient element 10 is now further discussed with reference to FIGS. 2*a*, 2*b* and 3. The elastic resilient element 10 comprises shut-off valve 6 and spring means 5; shut-off valve 6 is attached to spring means 5 by elastic coupling means, which are, in the embodiment shown in FIGS. 2*a* and 2*b*, narrow, elastic strips 13. Before being mounted in the can, a portion of the elastic resilient element 10 is bent backwards so that a bent-back portion 5' is obtained. This bent-back portion 5' may include a curved portion 5" and an end portion 5'". The end portion 5'" of bent-back portion 5' is biased against the underside of shut-off valve 6 (FIG. 3*a*). Strips 13 and spring means 5, that includes the bent-back portion 5', bias shut-off valve 6 against the underside of the can end 2 (FIG. 1*b*). Referring again to FIG. 3*a*, some embodiments of the elastic resilient element 10 may further comprise an extended portion 14 of end portion 5'" and/or a protrusion 33; both are shown in the embodiment of FIG. 3*a*. The extended portion 14, that may be a narrow strip, is positioned underneath rim 30 of can end 2, and acts as a security pressure relief. The protrusion 33 is used to reclose the can in some embodiments. Both protrusion 33 and the security pressure relief are discussed in more detail further below, as well as the other portions of the elastic resilient element 10. Elastic resilient element 10 may be made of a type of material having good resilient properties, e.g. a metal such as steel. Elastic resilient element 10 may have an opening 11 (shown in FIG. 2*b*) through which it may be attached to the can end 2, via a fixing device such as a rivet 12 (FIGS. 3*a* and 3*b*). In FIG. 3*a*, pull tab 4 is attached to can end 2 by another rivet 52.

Opening, reclosing and reopening embodiments of a can in accordance with the invention are illustrated in FIGS. 4 to 10, which show side views of a can wherein the front half is cut away.

FIG. 4 shows an embodiment of a can in accordance with the invention that is opened for the first time. Pull tab 4 is actuated by a user in the direction of arrow 61 and thereby removes cap top 3 from can end 2 by tearing if off along pre-formed groove 9. Cap top 3, on top of shut-off valve 6, is pushed downwards and against the force exerted by elastic resilient element 10 on shut-off valve 6, by the action of pull tab 4.

In FIG. 5, pull tab 4 is moved still further in the direction of arrow 62. By this action, the curved portion 5" (see FIGS. 4 and 5) of the bent-back portion 5' of elastic resilient element 10 is stretched, as is indicated by arrow 63 in FIG. 5. This stretching is caused by the geometry, in general the shape, and the elastic properties of the elastic resilient element 10. The stretching is important since protrusion 33 is thus brought nearer to the side wall 35 of the can, which will be used to reclose the can, as will be discussed in connection to FIGS. 7 and 8. Thus, in a preferred embodiment the bent-back portion 5' has a shape such that, upon opening the can, the protrusion 33 is moved nearer to the side wall 35 of the can.

The next step is shown in FIGS. 6*a* and 6*b*. Pull tab 4 is now moved, in the direction of arrow 64, back to its original position. Shut-off valve 6, and on top of it cap top 3, are held in an opened position, as is best shown in FIG. 6*b* which is a detail of the area indicated in FIG. 6*a*. The can is now in a position for drinking or pouring. Shut-off valve 6 is held in an opened position by holding means 32, which is in the embodiment of FIGS. 6*a* and 6*b* a slit (also shown in FIG. 1*b*) engaging with an engaging element 31 of shut-off valve 6. Of course other holding means can be used. In another embodiment, the holding means of the elastic resilient element is a hook, that engages with engaging element of the shut-off valve.

Figure 7:
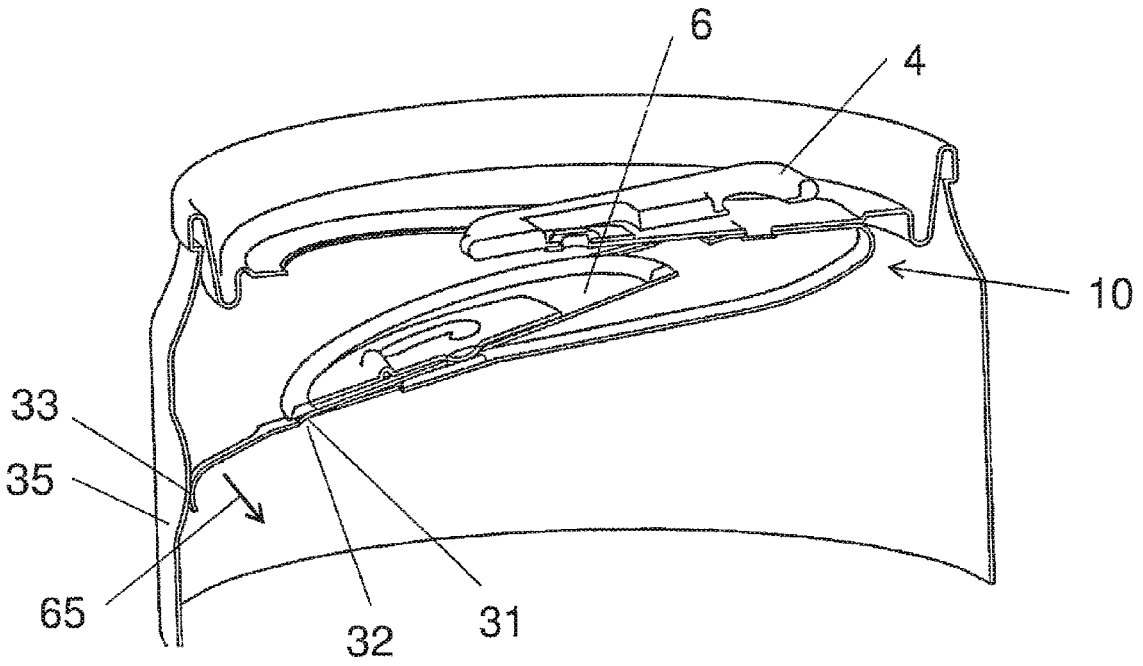
Figure 8:
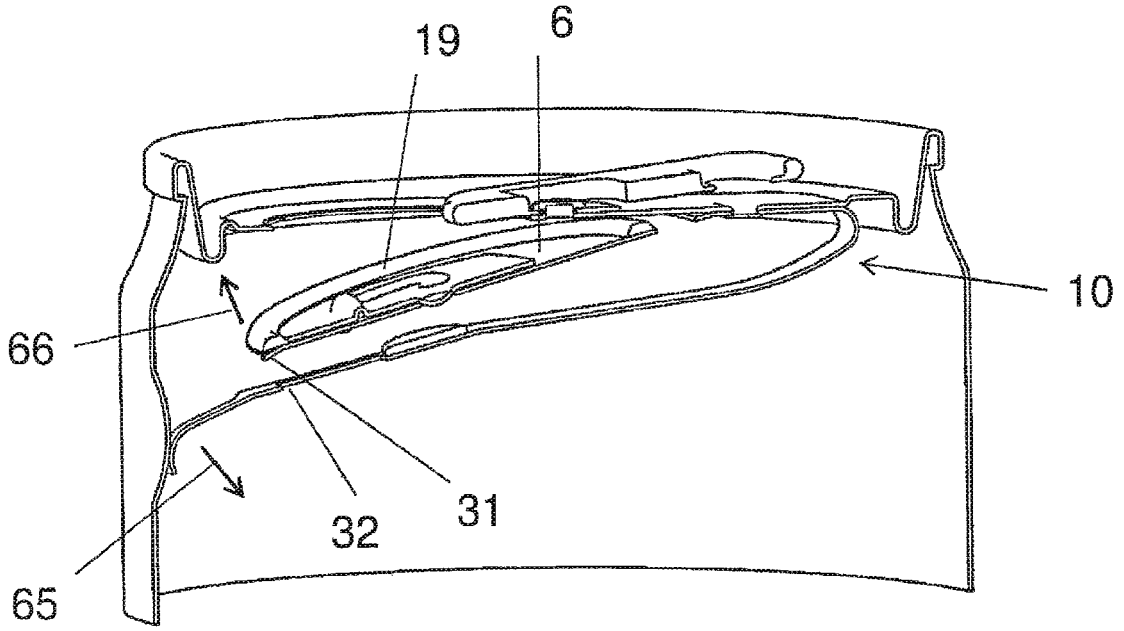

An embodiment of reclosing the can is shown in FIGS. 7 and 8. In the embodiment of FIG. 7, the user pushes gently against the side wall 35 of the can at a location opposite to the pull tab 4. The side wall of a can is thin, and the user thus exerts a force, through the side wall 35, on the protrusion 33 of the end of the bent-back portion of the elastic resilient element 10. Protrusion 33 now moves in the direction of arrow 65, and the engaging element 31 and the holding means 32 disengage, as shown in FIG. 8. Because of the force exerted by elastic resilient element 10, the shut-off valve 6 now moves in the direction of arrow 66, to close the drinking aperture.

Figure 9A:
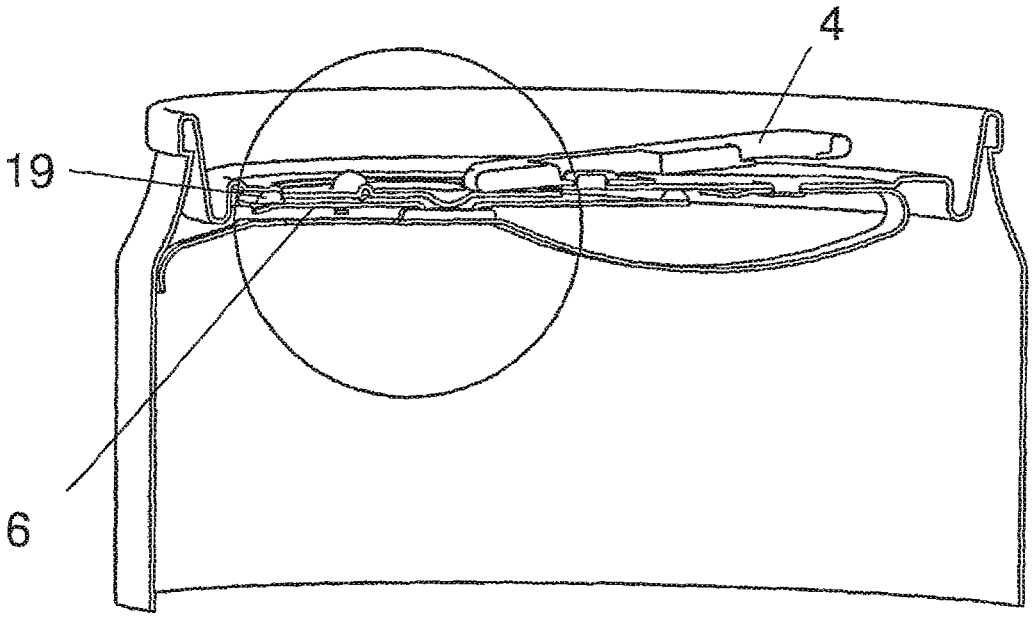
FIGS. 9*a* and 9*b* show a reclosed can.
Figure 9B:
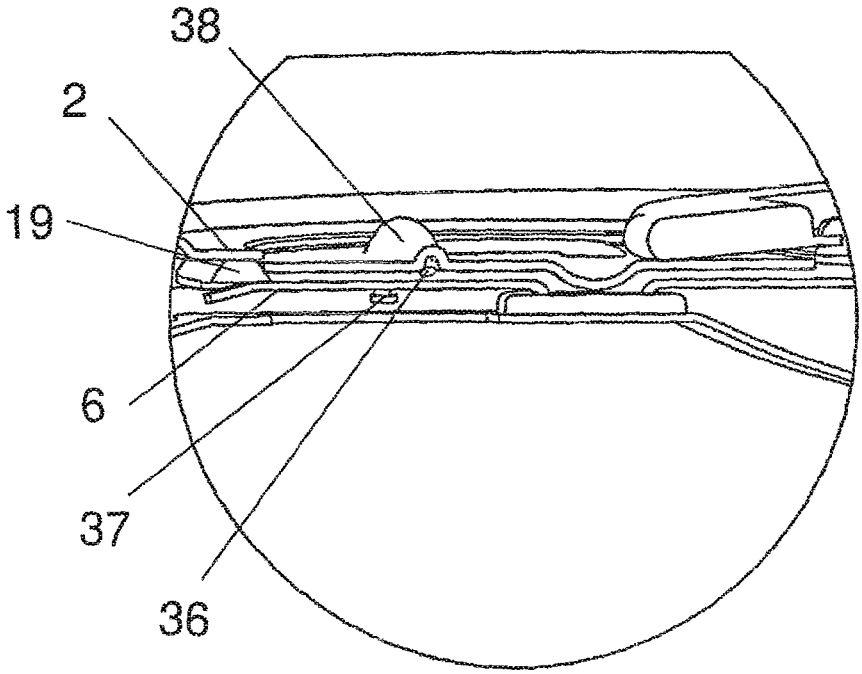

FIG. 9*a* and FIG. 9*b*, which is a detailed view of the area indicated in FIG. 9*a*, show an embodiment of the reclosed can. Shut-off valve 6 now has closed the drinking aperture, which is tightly sealed by seal 19 of shut-off valve 6. The shut-off valve 6 has such a seal 19 all around its circumference, so that the drinking aperture is tightly closed (e.g. in FIG. 8, only half of this seal, and half of the shut-off valve, is shown—the front half is cut away in this drawing; in FIG. 17*a*, the complete seal is shown). Seal 19 may e.g. be made from silicone or another suitable material. In the embodiment shown in FIG. 9*b*, the cap top 3 is now a small distance, e.g. a few tenths of mm, below the plane of can end 2. An advantage is that burrs, that may occur on the border of the cap top 3 due to the tearing removal of the cap top upon opening of the can, will not touch the can end 2. Thus, these burrs will not entangle with the drinking aperture, and will not hinder reopening of the can. In the embodiment of FIGS. 9*a* and 9*b*, the cap top 3 may move slightly towards the shut-off valve 6 after the can is opened, because of the way the cap top 3 is fastened to the shut-off valve 6. In this embodiment, two staples 36 are used (only one staple 36 is shown in FIGS. 9*a* and 9*b*). Each staple 36 is clamped to an embossment 38 in the cap top 3, pierces the shut-off valve 6 via a hole 21, and ends in a thickening, a so-called mushroom 37. (Two embossments 38 for staple means 36 are shown in FIG. 3*b*). When the can is opened for the first time, the staple means 36 are pushed downwards, and the thickness of seal 19 is large enough so that, when the can is reclosed, the cap top 3 is a small distance below the plane of can end 2, as discussed above. Further, the staples 36 are long enough so that cap top 3 remains located on top of shut-off valve 6, but can still move a bit upwards or downwards. Of course cap top 3 may be fastened in other ways to shut-off valve 6.

Figure 10A:
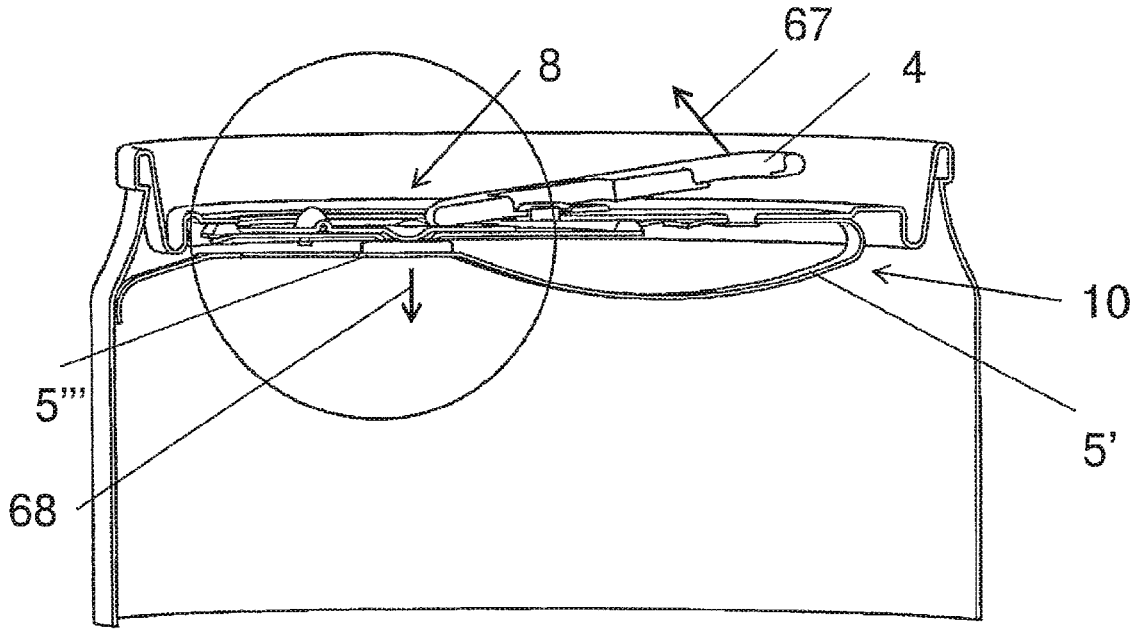
FIGS. 10*a* and 10*b* show reopening of a can, including pressure relief.
Figure 10B:
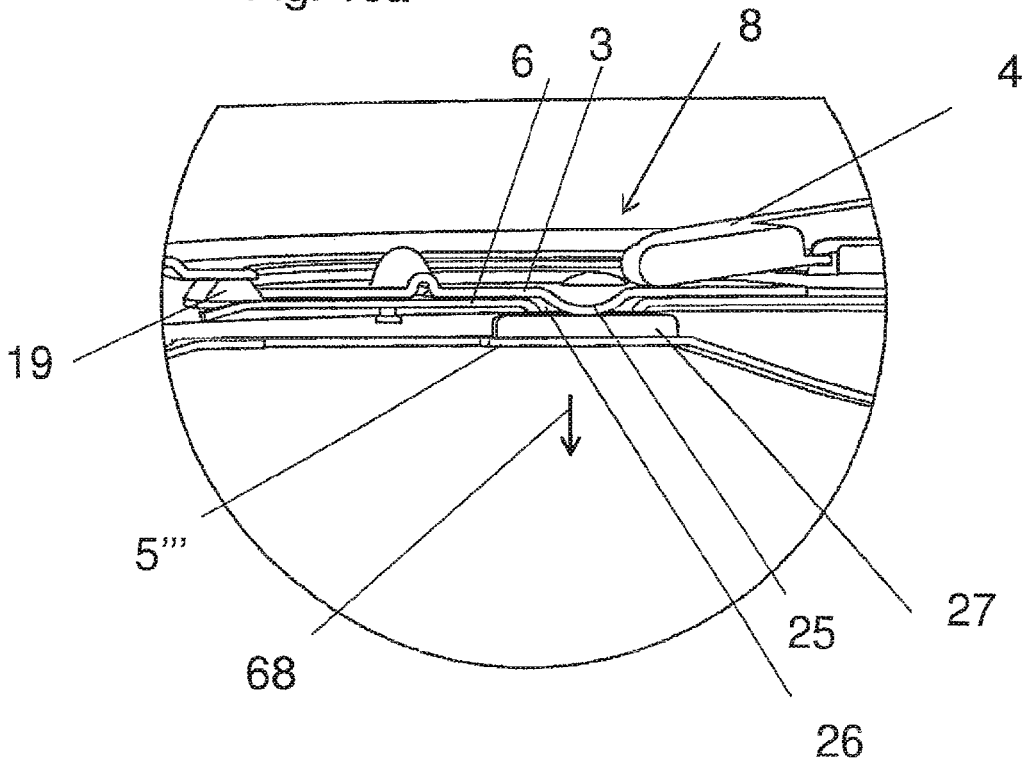

FIG. 10*a* and FIG. 10*b*, which shows in detail the area indicated in FIG. 10*a*, illustrates reopening a can, wherein the can includes an embodiment of a pressure relief valve 8. To open the can, the user actuates pull tab 4 in the direction of arrow 67. This first pushes cap top 3 downwards. Cap top 3 comprises a bulging portion 25, pointing downwards. Shut-off valve 6 has a hole 26, positioned in front of bulge 25. Hole 26 may have a crater-shaped cross-section, in order to receive the bulge 25. Bent-back portion 5' of elastic resilient element 10 is provided near its end with and end portion 5''' which is substantially parallel to shut-off valve 6 and which is provided with a seal element 27 which effectively closes the opening 26 when the can is not used by the consumer, since the end portion 5''' is then biased against the underside of shut-off valve 6. When actuating pull tab 4 in the direction of arrow 67, cap top 3 is pushed downward and bulge 25 pushes—through hole 26—against seal element 27. Thus, end portion 5''' is pushed away from the shut-off valve 6, in the direction of arrow 68, before the shut-off valve 6 itself opens. This action releases pressure from inside the can through opening 26 and thereafter facilitates opening of the shut-off valve 6 itself, when pull tab 4 is further moved in the direction of arrow 67. Thus, the opening 26 together with the bulging portion 25 and the seal 27 act as a pressure relief valve 8.

Preferably, a can in accordance with the invention also includes a security pressure relief means. One embodiment is shown in FIG. 3*a*. This cross section of a can shows that the extended portion 14 of end portion 5''' of elastic resilient element 10 extends underneath the rim 30 of the can end 2. The extended portion 14, together with pressure relief valve 8, acts as a security pressure relief means, as will now be explained. When an already opened can that contains a carbonated beverage is resealed by shut-off valve 6, pressure builds up underneath the can end, as discussed already above. As the drinking opening has been created, the strength of the can end has significantly decreased, and the can end may gradually deform under the built up pressure. Such a deformation causes the can end to bulge outwards. Especially in high temperatures, this effect may become important and there may be a risk of rupture of the can. However, when the can end has deformed to a certain degree, extended portion 14 comes into contact with the rim 30 of the can end (see FIG. 3*a*). When the deformation continues, extended portion 14 will be pushed downwards and eventually cause seal 27 to be removed from opening 26, thus opening the pressure relief valve 8. Gases are thus released and pressure inside the can decreases, so that the deformation decreases as well. Thus, extended portion 14, together with relief valve 8, provides a security pressure relief means: even at very high pressure, a can that contains a carbonated beverage will not be ruptured and will not explode.

Figure 11:
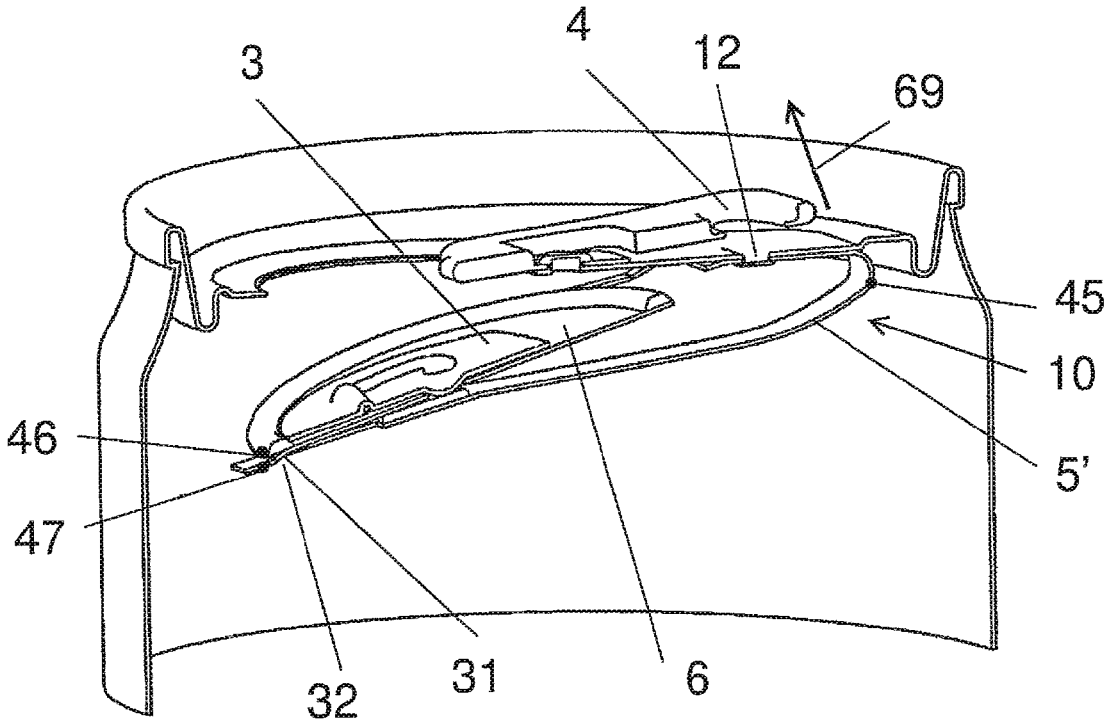
FIG. 11 shows another embodiment of a can end and the top portion of a can wherein the front half is cut away.

FIG. 11 represents an embodiment of a can end and a can without a protrusion 33 of the end of the bent-back portion of the elastic resilient element 10 (compare FIG. 11 to FIG. 7). The embodiment of the can of FIG. 11 has the same engaging element 31 of the shut-off valve 6 and the same holding means 32 of the elastic resilient element 10 as the embodiment shown in FIG. 7. The embodiment of the can of FIG. 11 cannot be reclosed by gently pushing against the sidewall of the can. Instead, such a can is closed by gently tapping against the can, e.g. by putting the can on a table with a small shock. By such gentle tapping, the engaging element of the shut-off valve and the holding means of the elastic resilient element (e.g. a hook and a slit) disengage, and the shut-off valve is closed by the force exerted on it by the elastic resilient element. The user can also e.g. hold the can in one hand and gently tap the can with a finger of the other hand. He can also push gently on the cap top 3 in its opened position, e.g. with his thumb. Any of these actions will close the can. Another advantage of this embodiment is that the can will automatically reclose when it is dropped or tipped over; thus, the content of the can will not be spilled if the can accidentally falls.

FIG. 11 further shows an embodiment of the positions of two hinge points: the hinge point 45, around which the bent-back portion 5' of the elastic resilient element 10 rotates, and the rivet 12, fastening the elastic resilient element, and also acting as a hinge point around which the shut-off valve 6 rotates. Because of the relative positioning of these two hinge points, when the can is opened by actuating the pull tab 4 in the direction of arrow 69, the end point 46 of shut-off valve 6 moves on a circle with a smaller radius than point 47 near the end of bent-back portion 5' of elastic resilient element 10. Therefore, although the holding means 32 of the elastic resilient element 10 is initially nearer to the two hinge points than the engaging element 31 of the shut-off valve, by opening the can the engaging element and the holding means will come closer to each other and will engage. Further, in the embodiment shown in FIG. 5, the bent-back portion of elastic resilient element 10 is stretched when opening the can (see arrow 63 in FIG. 5), which also contributes to the engaging element and the holding means coming closer to each other.

Figure 12A:
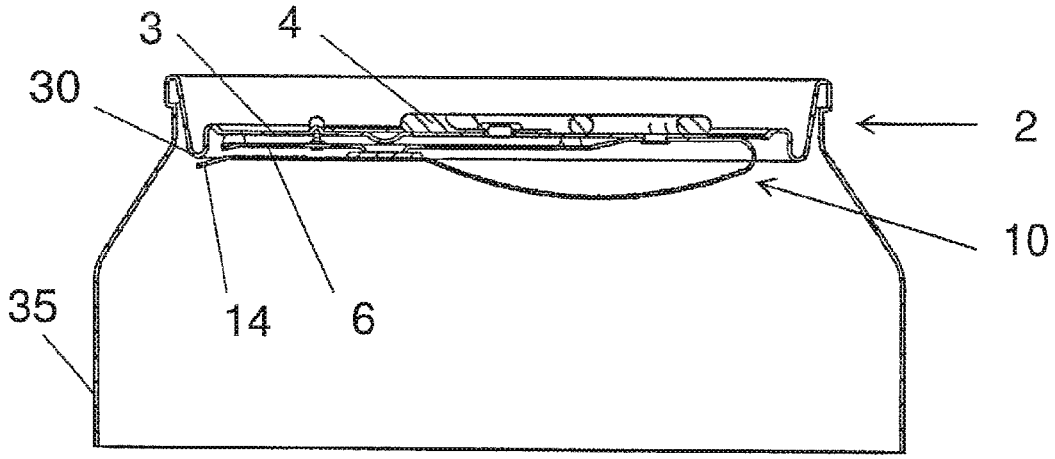
FIG. 12*a* shows a cross section along line B-B in FIG. 12*b;*
Figure 12B:
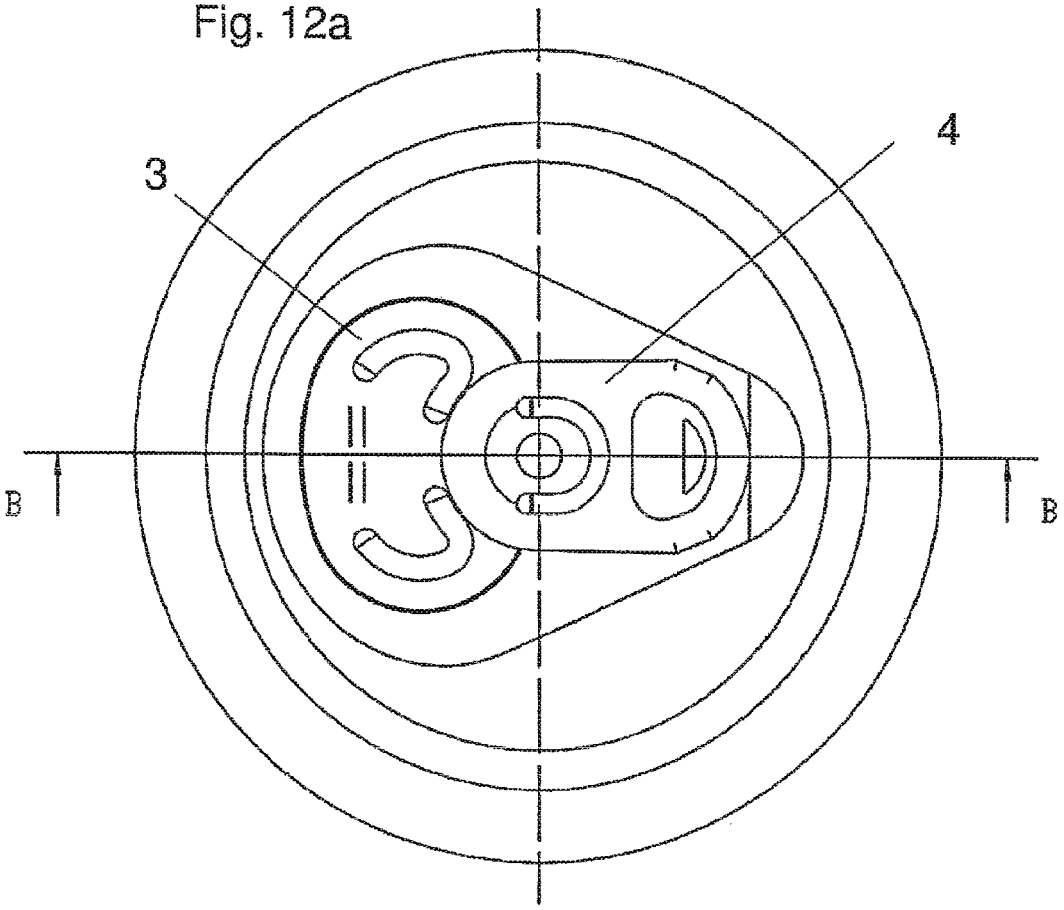
FIG. 12*b* shows a top view of an embodiment of a can end and the top portion of another type of can, before its first opening.
Figure 13A:
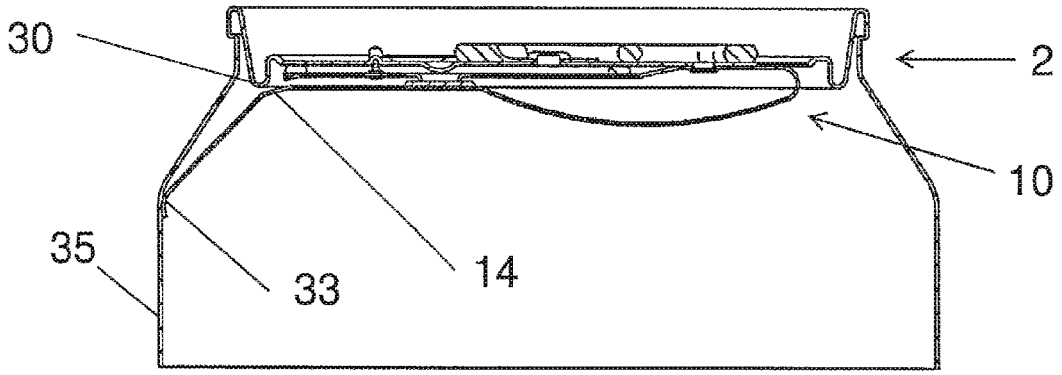
FIG. 13*a* shows a cross section along line C-C in FIG. 13*b;*
Figure 13B:
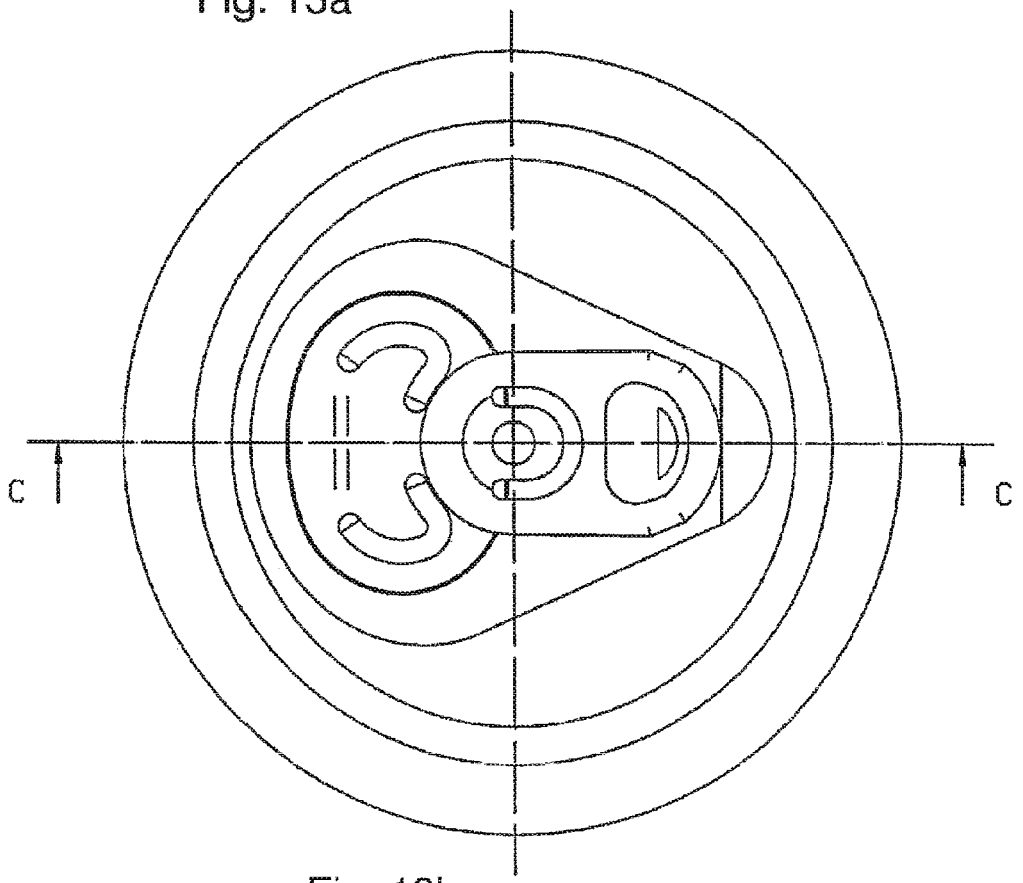
FIG. 13*b* shows a top view of another embodiment of a can end and the top portion of the type of can shown in FIGS. 12*a* and 12*b*, before first opening of the can.
Figure 14A:
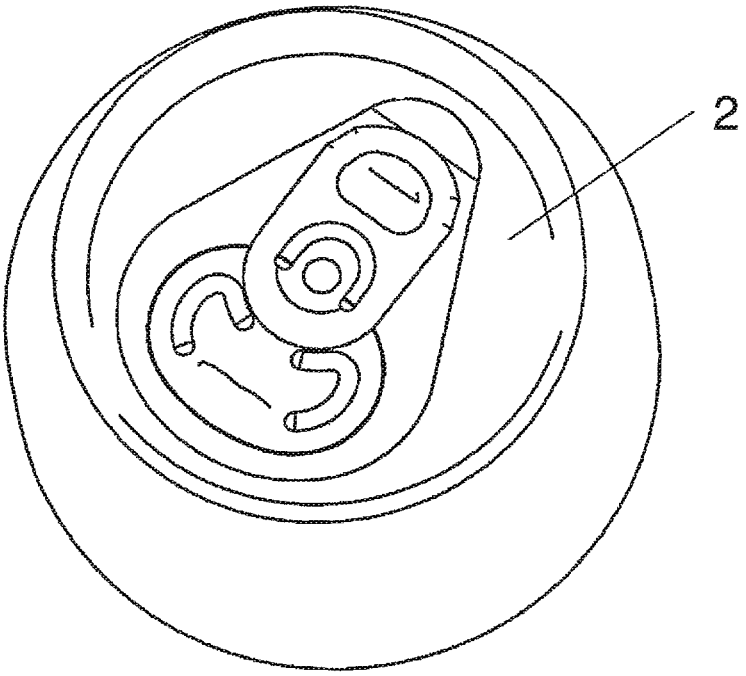
FIGS. 14*a* and 14*b* show, for the embodiment of FIGS. 13*a* and 13*b,* 3D views of the can end and the top portion of a can, seen respectively from the top and from the bottom.
Figure 14B:
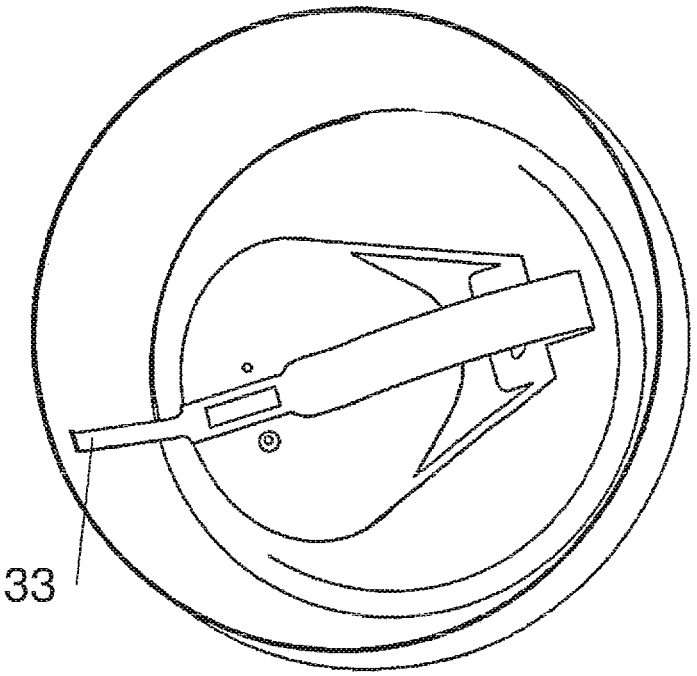

As mentioned already above, the present invention can be applied to different types of cans: standard cans, slim sized cans, super sized cans, etc. FIGS. 3*a* and 3*b* show a slim sized can; such cans are used e.g. for Red Bull™ drinks. For a standard can, such as is used in general for Coca Cola™ drinks, FIGS. 12*a* and 12*b* show the same views as FIGS. 3*a* and 3*b*, i.e. a top view of the can before its first opening in FIG. 12*b* and a cross section along line B-B in FIG. 12*a*. These standard cans have a larger drinking opening, as is clear when comparing the cap top 3 in FIG. 12*b* with the one in FIG. 3. Another difference is the larger distance between the rim 30 of the can end and the side wall 35 of the can. Due to this large distance, in order to close the can by pushing against the side wall 35, a very long protrusion 33 is required as shown in FIG. 13*a* and in FIG. 14*b* (which represent respectively a cross section along line C-C in the top view shown in FIG. 13*b*, and a 3D view of the can end and top portion of the can, from the bottom). A can end 2 having an elastic resilient element 10 with such a long protrusion 33 is more difficult to mount on a can body, as will be discussed further below. Further, when in a production line the can ends are transported, e.g. on a belt, to the station where they will be mounted on the can bodies, the long protrusions may become entangled and thus cause transportation problems. Therefore, it may be preferable to use an embodiment without protrusion, as shown in FIGS. 12*a* and 12*b*, instead of the embodiment with protrusion, as shown in FIGS. 13*a*, 13*b*, 14*a* and 14*b*. Such a can will then not be closed by pushing against the side wall, but it will be closed e.g. by tapping, as discussed above.

Figure 15A:
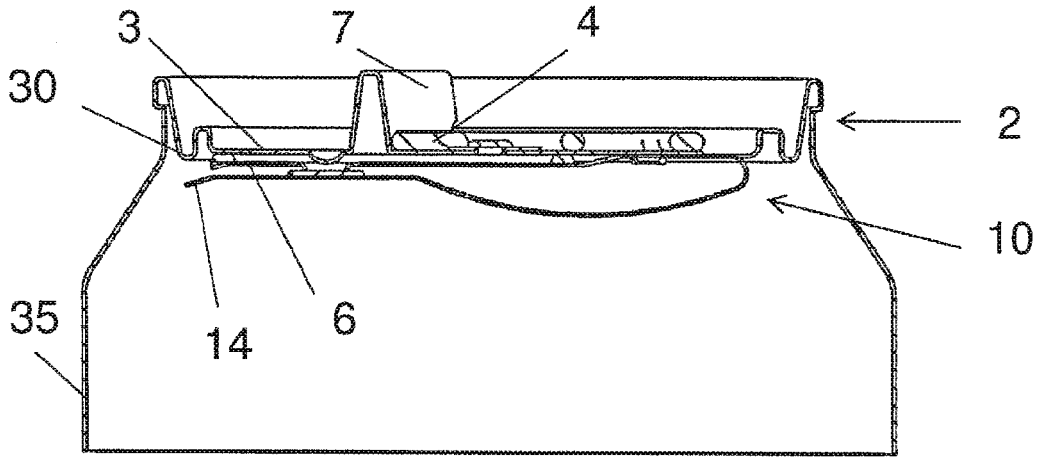
FIG. 15*a* shows a cross section along line F-F in FIG. 15*b;*
Figure 15B:
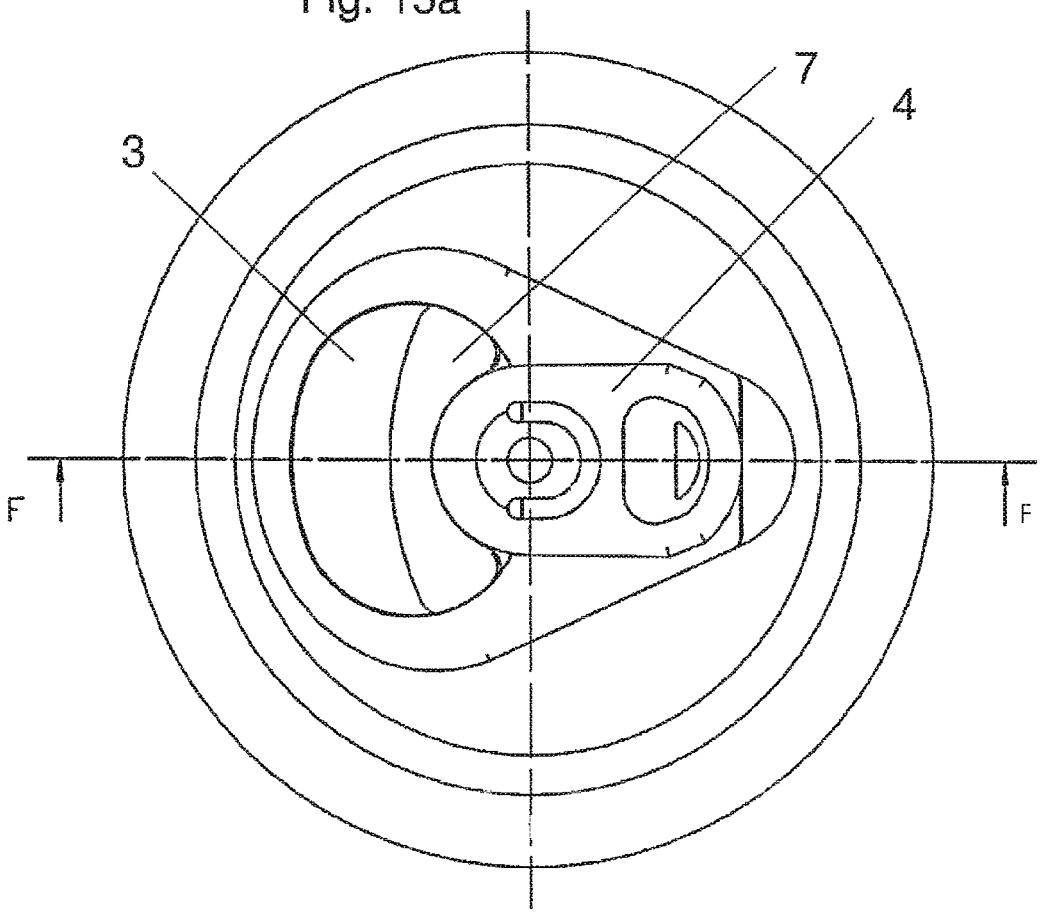
FIG. 15*b* shows a top view of an embodiment of a can end and the top portion of a can having a raised lip-contact portion, before its first opening.
Figure 16A:
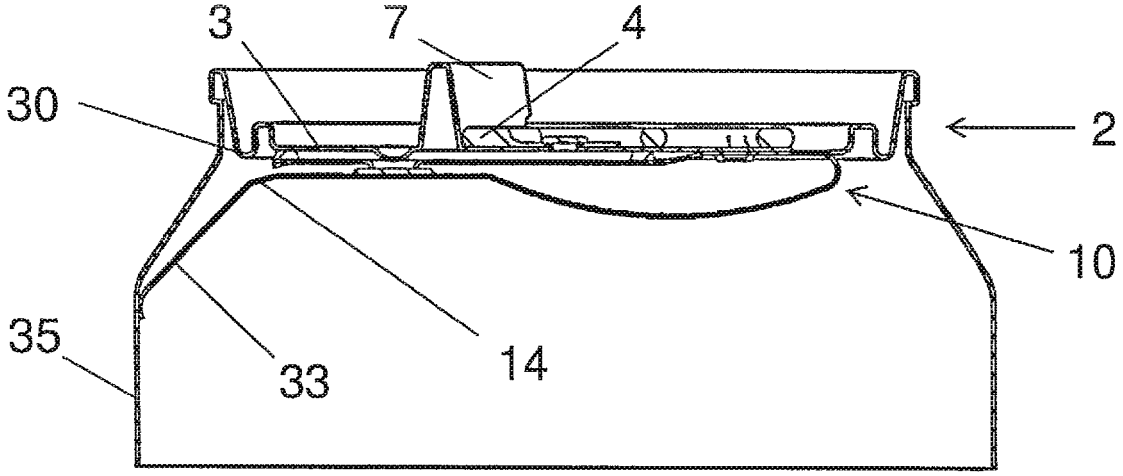
FIG. 16*a* shows a cross section along line E-E in FIG. 16*b;*
Figure 16B:
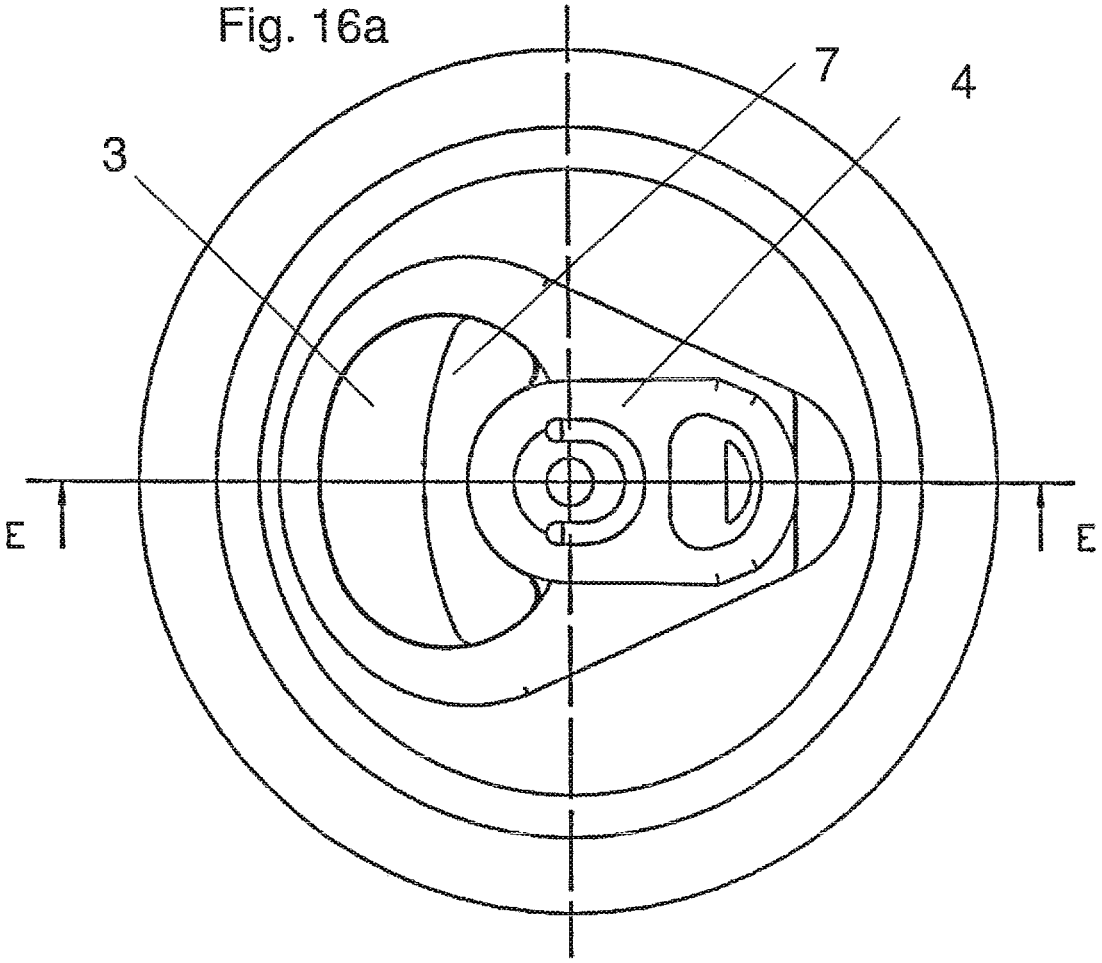
FIG. 16*b* shows a top view of another embodiment of a can end and the top portion of a can having a raised lip-contact portion, before first opening of the can.

To reopen a can in accordance with the invention, a user may move the cap top in different ways, as mentioned already above. The cap top may be moved by moving the pull tab 4, as discussed already above. FIGS. 15 and 16 show another embodiment of a can end, wherein the cap top 3 comprises a raised lip-contact portion 7 on its upper surface. By contacting the raised lip-contacting portion 7 with his lips, the consumer pushes the cap top down, and creates an opening, so that he can drink from the can. Functioning of such a lip-contacting portion is discussed and explained in detail in patent application PCT/EP2011/052078, filed by the same applicant as the present patent application, and incorporated herein by reference. FIGS. 16*a* and 16*b* show an embodiment of a can having a raised lip-contact portion 7 and comprising a protrusion 33 of the end of the bent-back portion of the elastic resilient element 10. FIGS. 15*a* and 15*b* show another embodiment of a can having a raised lip-contact portion 7 and having no protrusion 33. The lip-contact portion 7 may be used to push the cap top 3 down far enough so that the shut-off valve 6 may be held by holding means 32, as explained above. It may also be used to push cap top 3 less far down, so that shut-off valve 6 closes, by the force of the elastic resilient element 10, when the pressure exerted on the lip-contact portion 7 is taken away. In another embodiment, a can end includes a raised lip-contact portion 7 but no holding means 32, so that the shut-off valve 6 is automatically closed when the consumer stops pushing the lip-contact portion 7 down, and this irrespective of the depth that the lip-contact portion was pushed down.

Figure 17A:
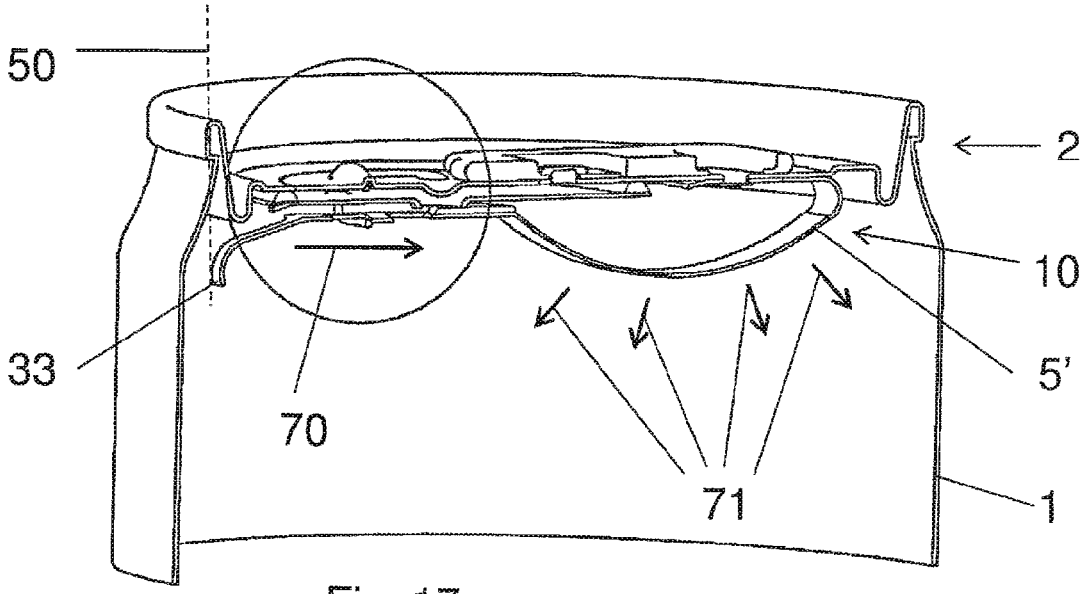
FIGS. 17*a* and 17*b* show an embodiment of a can end and the top portion of a can wherein the front half is cut away.
Figure 17B:
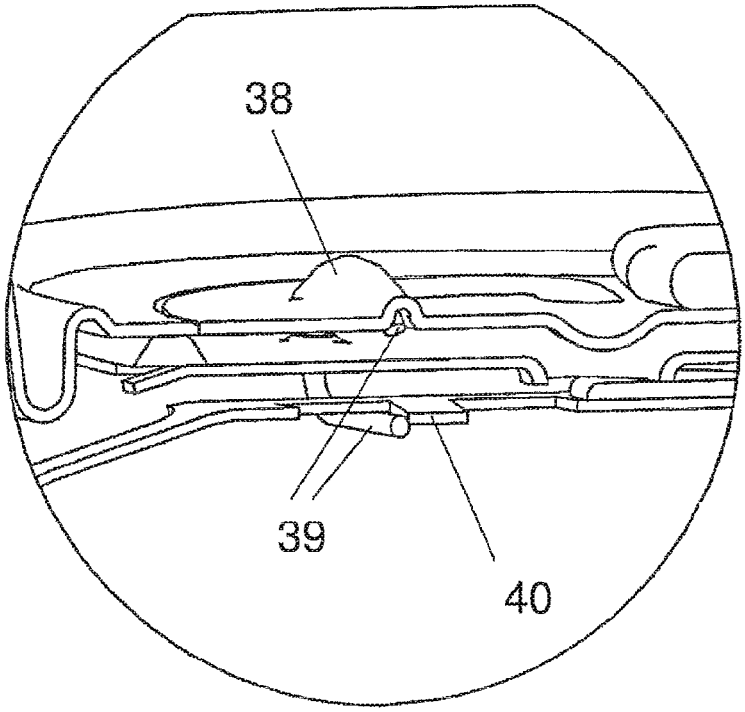
Figure 18:
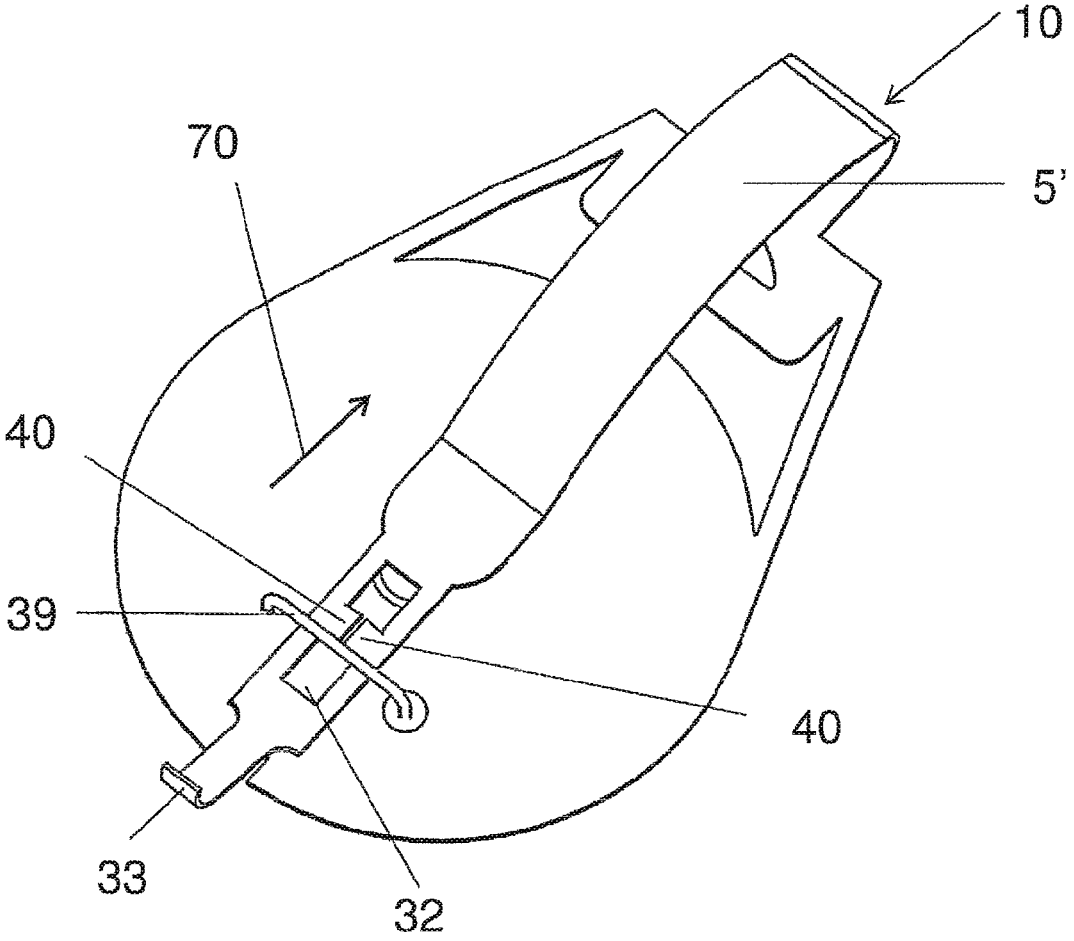
FIG. 18 shows a 3D view of the bottom side of an embodiment of an elastic resilient element.
Figure 19A:
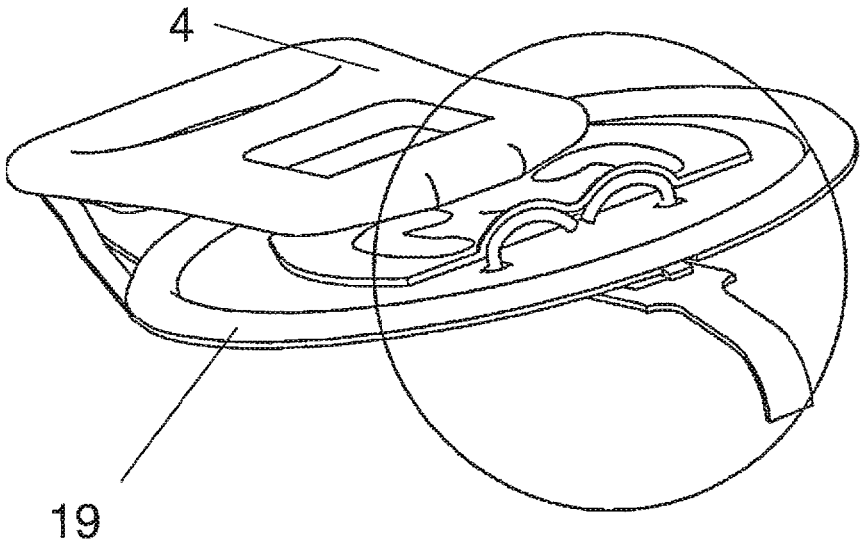
FIGS. 19*a* and 19*b* show an embodiment of an elastic resilient element, a cap top and a pull tab.
Figure 19B:
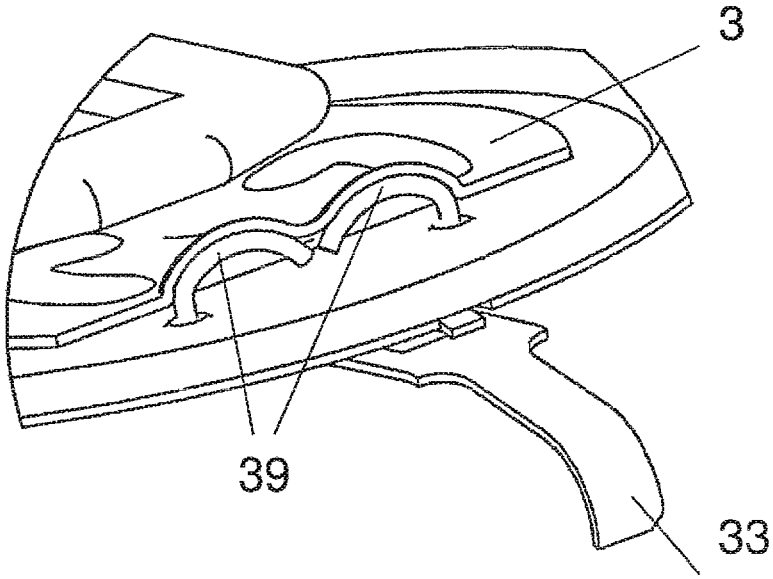

Mounting an embodiment of a can end 2 on a can body 1, wherein the can end 2 comprises an elastic resilient element 10 having a protrusion 33, is now discussed with reference to FIGS. 17*a* and 17*b*, wherein FIG. 17*b* shows a detail of the area indicated in FIG. 17*a*. Only half of the can end 2 and the top portion of the can body 1 is shown; the front half is cut away. If the protrusion 33 sticks out further than the contour of the can end 2, the can end 2 may be held slightly inclined to mount the can end 2 on the can body 1, before it is attached to the can body 1. It is also possible to keep the can end horizontal during mounting, or to hold it at a smaller inclination angle, by means of an embodiment as shown in FIGS. 17*a* and 17*b*. In this embodiment, a single staple 39 is used instead of the two staples 36 discussed above with reference to FIGS. 9*a* and 9*b*. This single staple 39 attaches the cap top 3 to the can end 2 (which is also a function of the two staples 36) and additionally it forms a closed connection beneath the bent-back portion 5' of the elastic resilient element 10, as is also shown in FIG. 18, which is a 3D view of the bottom side of the elastic resilient element 10. FIG. 19*a* shows a 3D view of staple 39 and FIG. 19*b* shows a detail of the area indicated in FIG. 19*b*. In the embodiment shown in FIG. 18, the bent-back portion 5' now comprises two raised lips 40 that can interact with staple 39. Before mounting the can end 2 on the can body 1, the bent-back portion 5' can now be moved in the direction of arrow 70 on FIGS. 17*a* and 18. The bent-back portion 5' will then deform as shown by arrows 71 in FIG. 17*a* but, what is more important, the raised lips 40 will catch behind staple 39, as shown in FIG. 18 and in FIG. 17*b*. As shown in FIG. 17*a* by dotted line 50, the protrusion 33 now no longer sticks out further than the contour of the can end 2 (or, in some cases, it will stick out only slightly, and much less than was the case before). Can end 2 can now be mounted and attached much more easily to can body 1. When the can is opened for the first time, staple 39 is pushed downwards, analogously to the staples 36 as discussed above, and again staple 39 is long enough (in the direction approximately perpendicular to the cap top 3) so that the cap top 3 can still move slightly downwards or upwards. Moreover, staple 39 is long enough so that, when it is pushed downwards when the can is opened for the first time, the raised lips 39 move past staple 40 (in the direction opposite to the direction of arrow 70), so that the elastic resilient element can now function as explained hereinbefore; the position of the elastic resilient element 10 in FIG. 17*a* is only for mounting purposes. Of course, instead of staple 39, other staple means as known in the art may be used.

Figure 20:
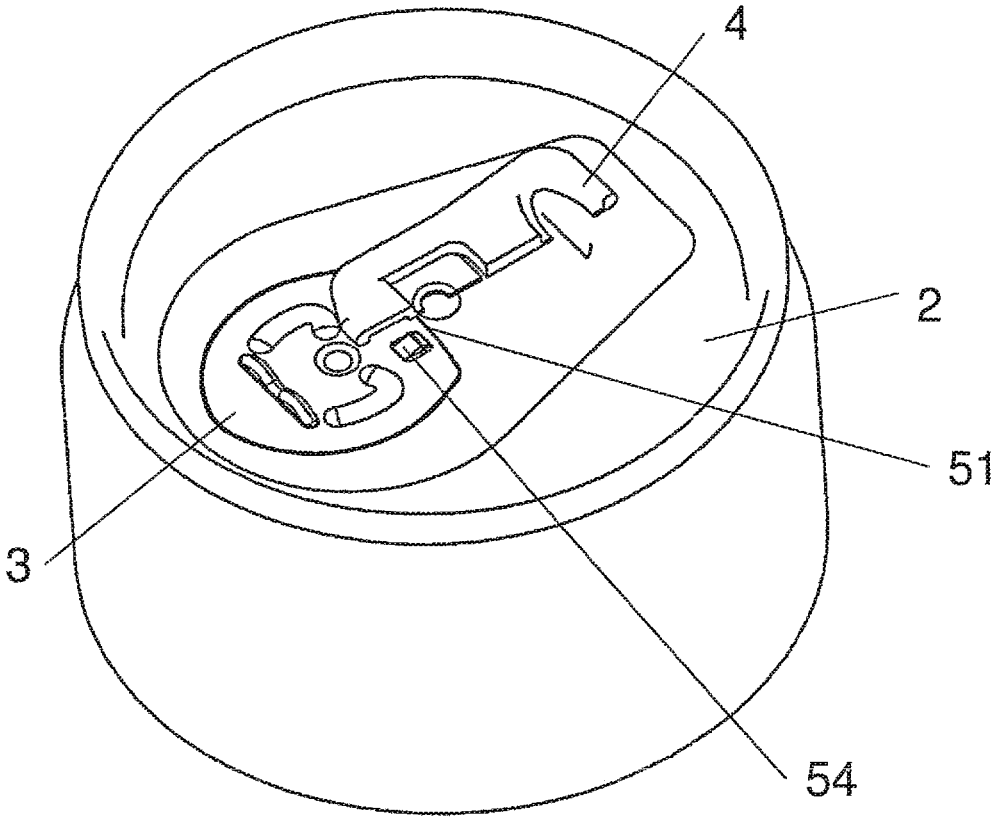
FIG. 20 shows an embodiment of a can end and the top portion of a can wherein the pull tab is partially cut away.
Figure 21:
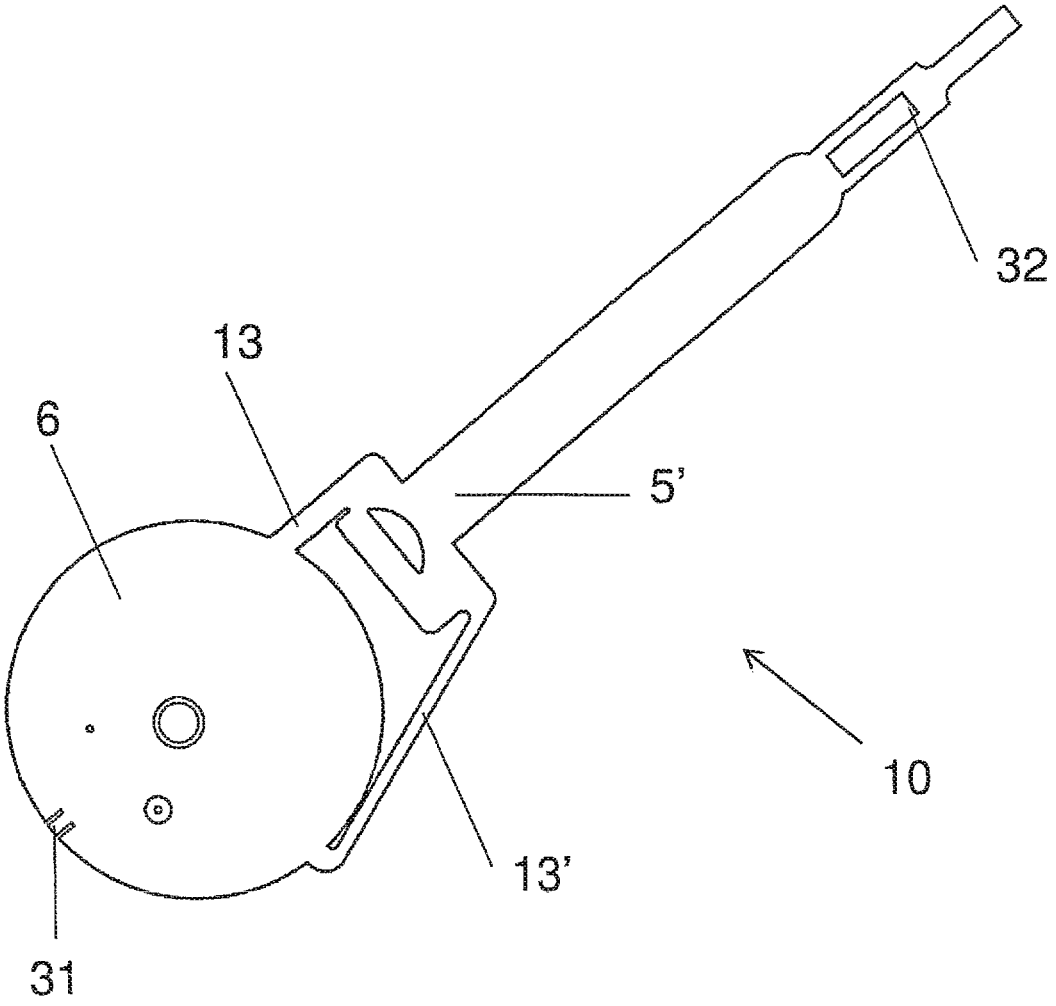
FIG. 21 shows an embodiment of an elastic resilient element having asymmetric elastic coupling means.

When opening the can for the first time, the cap top 3 is torn off completely, as discussed hereinbefore. In a preferred embodiment, tearing off the cap top is done asymmetrically. This is now discussed with reference to FIGS. 20 and 21, wherein FIG. 20 shows an embodiment of a can end 2 and the top portion of a can wherein the pull tab 4 is partially cut away. Tearing off the cap top asymmetrically avoids that, in case of complete symmetry with respect to the symmetry axis of the pull tab 4, the last portion of the cap top to be torn off, which is the zone 51 (FIG. 20) around this symmetry axis, is removed difficulty. Tearing off the cap top asymmetrically can be done in different ways. In one embodiment, an asymmetrically located embossment 54 as shown in FIG. 20 is provided in the cap top 3. There is only a single embossment 54 (at the side of the cap top 3 where the not cut-away portion of the pull tab 4 is shown, there is no embossment). Because of this asymmetrically located embossment 54, when opening the can for the first time, the pull tab 4 will exert different forces on the side of the cap top 3 located to the left of zone 51 and on the side of the cap top 3 to the right of zone 51, which causes the cap top to be torn off asymmetrically. In another embodiment, the elastic resilient element 10 is asymmetric. FIG. 21 shows such an embodiment. The elastic resilient element 10 in this drawing is still flat, i.e. portion 5' of spring means 5 is not yet bent backwards. In the shown embodiment, shut-off valve 6 is coupled to spring means 5 by elastic coupling means 13 and 13' that have asymmetric elastic properties. In the embodiment of FIG. 21, both coupling means 13 and 13' are narrow, elastic strips, but strip 13' is longer than strip 13 and is attached to shut-off valve 6 is such a way that the attachment zone is on a radius through the center of the, circular, shut-off valve 6. Because of the asymmetric elastic properties, the cap top will be torn off asymmetrically. This embodiment may be combined with the asymmetrically located embossment shown in FIG. 20.

Figure 22:
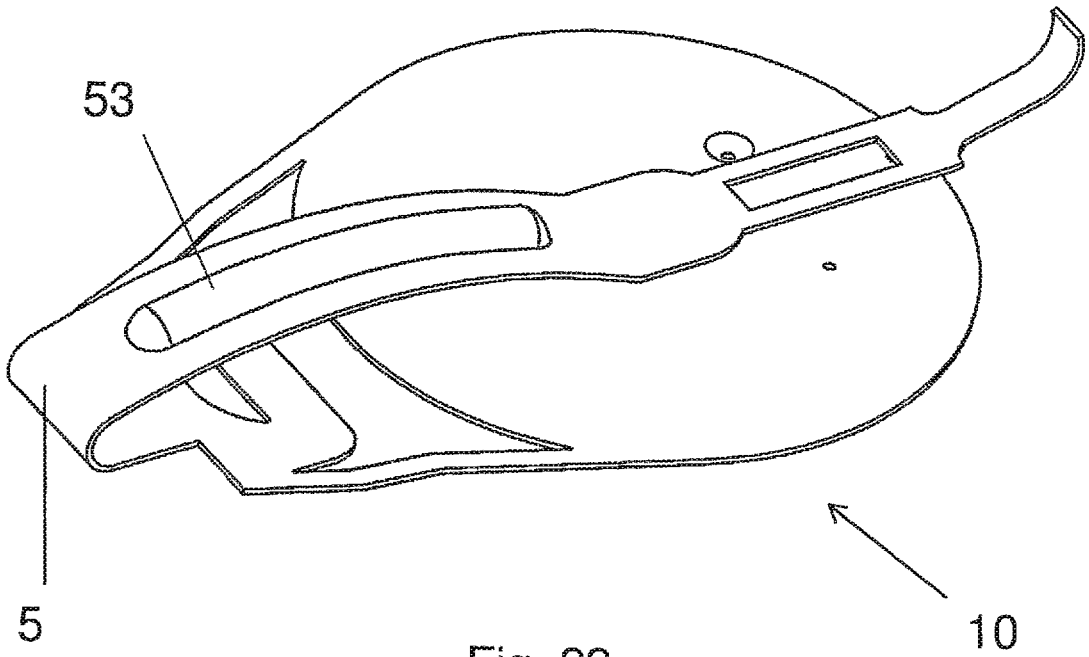
FIG. 22 shows an embodiment of an elastic resilient element with a strengthened portion.

Elastic resilient element may be a plate-like element. It is advantageous to use very thin plate, having a thickness of 0.25 mm or smaller, preferably 0.20 mm or smaller, more preferably 0.15 mm or smaller. The elastic resilient element then weighs only 1.5 g to 2 g. Such a small weight is important to keep the total weight of the can as low as possible. In the embodiment of the elastic resilient element shown in FIG. 22, the width of the spring means 5 is preferably 6 to 8 mm, but other dimensions are also possible. In order to have good elastic properties for the spring means 5, it has a strengthened portion 53 in the shown embodiment (in FIG. 22, the strengthening bulge points "outwards", of course it may also point in the opposite direction, i.e. "inwards").

Figure 23:
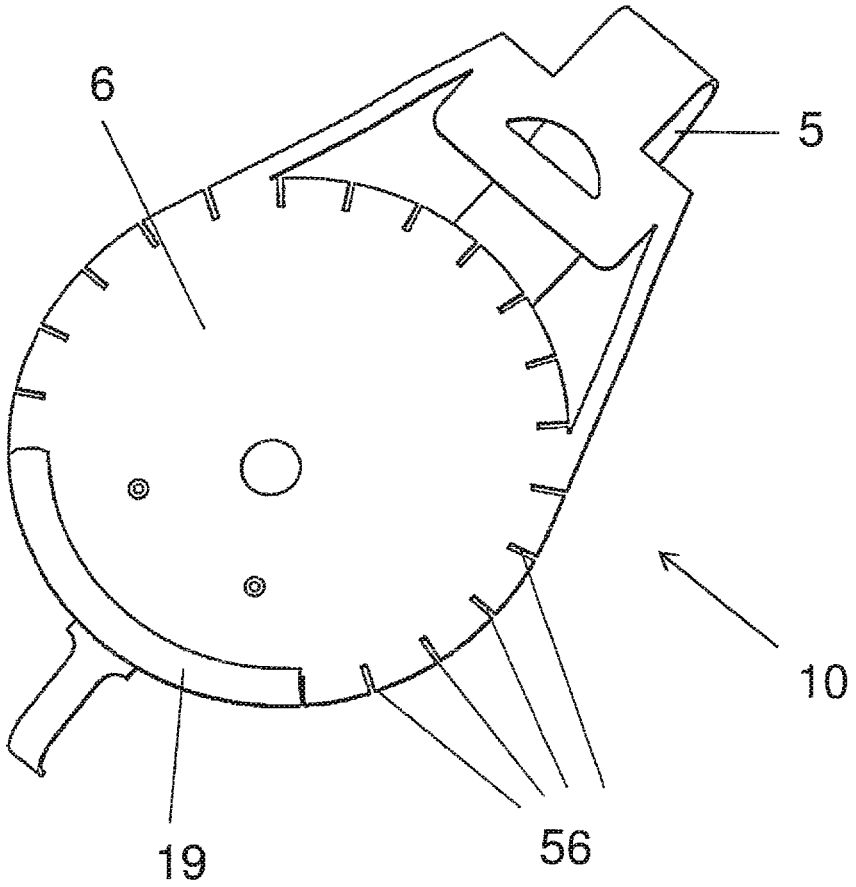
FIG. 23 shows an embodiment of an elastic resilient element including a shut-off valve with incisions.

FIG. 23 shows another embodiment of an elastic resilient element 10 (wherein a portion of spring means 5 is bent backwards). In this embodiment, shut-off valve 6 has a plurality of incisions 56 around its circumference (only a portion of seal 19 is shown; the rest is cut away to show the incisions). An advantage of these incisions is that they make the shut-off valve 6 more flexible at the location of seal 19, so that seal 19 will fit even better to the can end 2. An alternative to these incisions is to make the shut-off valve 6 thin enough, as discussed above. Of course also a thin shut-off valve may comprise incisions.

Figure 24A:
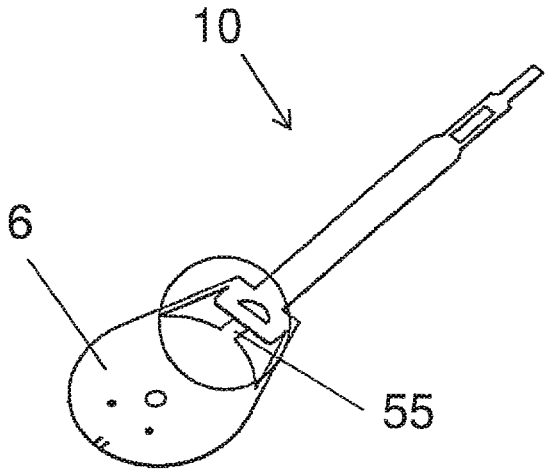
FIGS. 24*a* and 24*b* show an embodiment of an elastic resilient element including braking means.
Figure 24B:
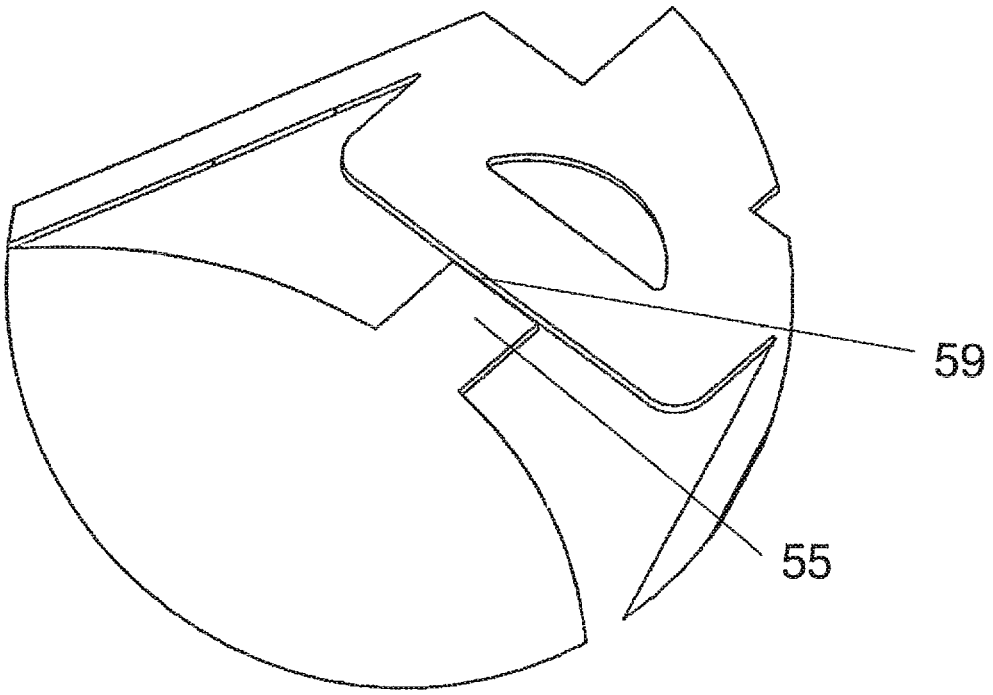

In FIGS. 24*a* and 24*b*, an embodiment of an elastic resilient element 10 (that is still flat) is shown that has braking means, or damping means, 55. When the shut-off valve 6 is being closed, the braking means 55 drag against the portion 59 of elastic resilient element 10, thus slowing down closing of the shut-off valve 6. This slowing down helps avoiding splashing of the content of the can during closing; it is not impossible that otherwise splashes might occur, depending on the type of the content and on the geometry and the material properties of the parts of the can end.

Figure 25A:
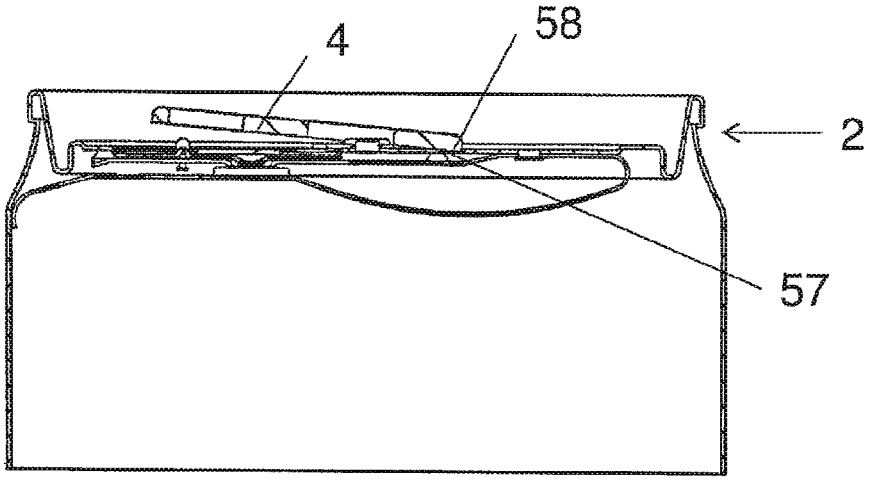
FIGS. 25*a* and 25*b* show an embodiment of a can having an additional locking feature.
Figure 25B:
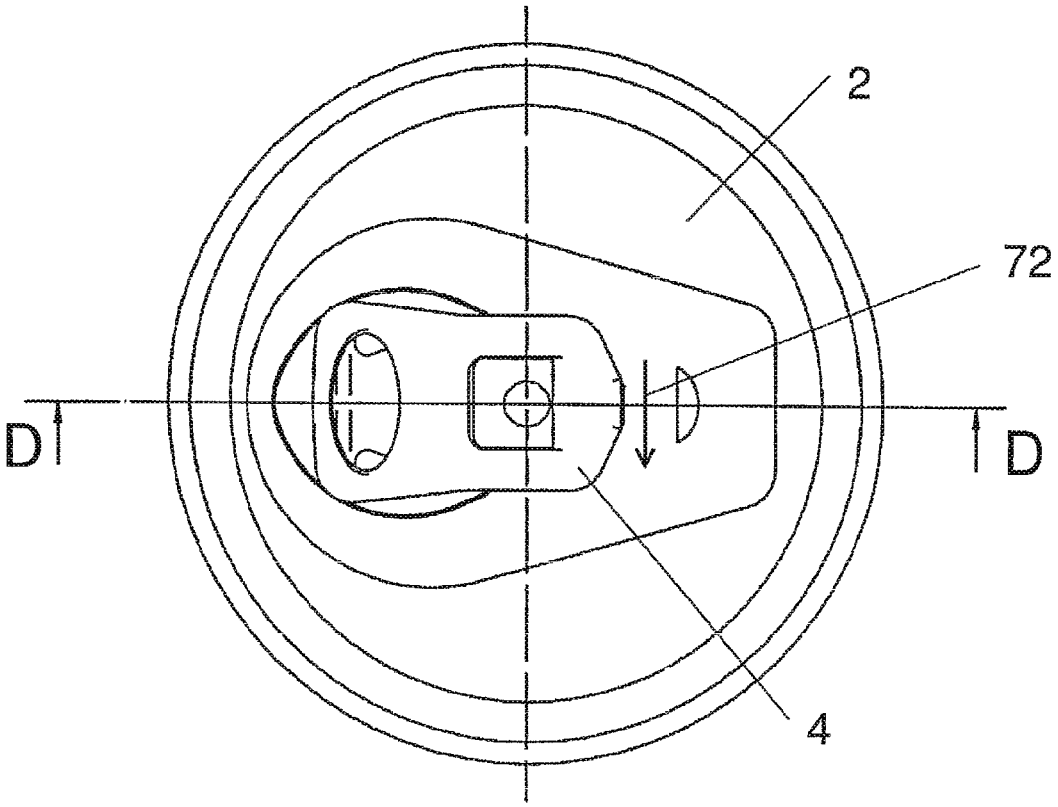

FIGS. 25*a* and 25*b* show an embodiment of a can having an additional locking feature, which is useful to transport a can that was already opened and that still contains a part of its contents. FIG. 25*b* shows a top view of the can end and the top portion of the can, and FIG. 25*a* shows a cross section along line D-D in FIG. 25*b*. With respect to its normal position, pull tab 4 was rotated over 180° in the direction of arrow 72. In this embodiment, can end 2 has al least one small groove 57, and pull tab 4 has at least one protuberance 58 fitting in this at least one groove. The pull tab 4 is thus locked in the shown position, and it is now possible to take away the can, that still contains part of its content, in a bag, e.g. a ladies' bag, and being sure that the can will not be opened inadvertently, e.g. by contact with other items present in the bag, which could otherwise spill the content of the can.

Figure 26:
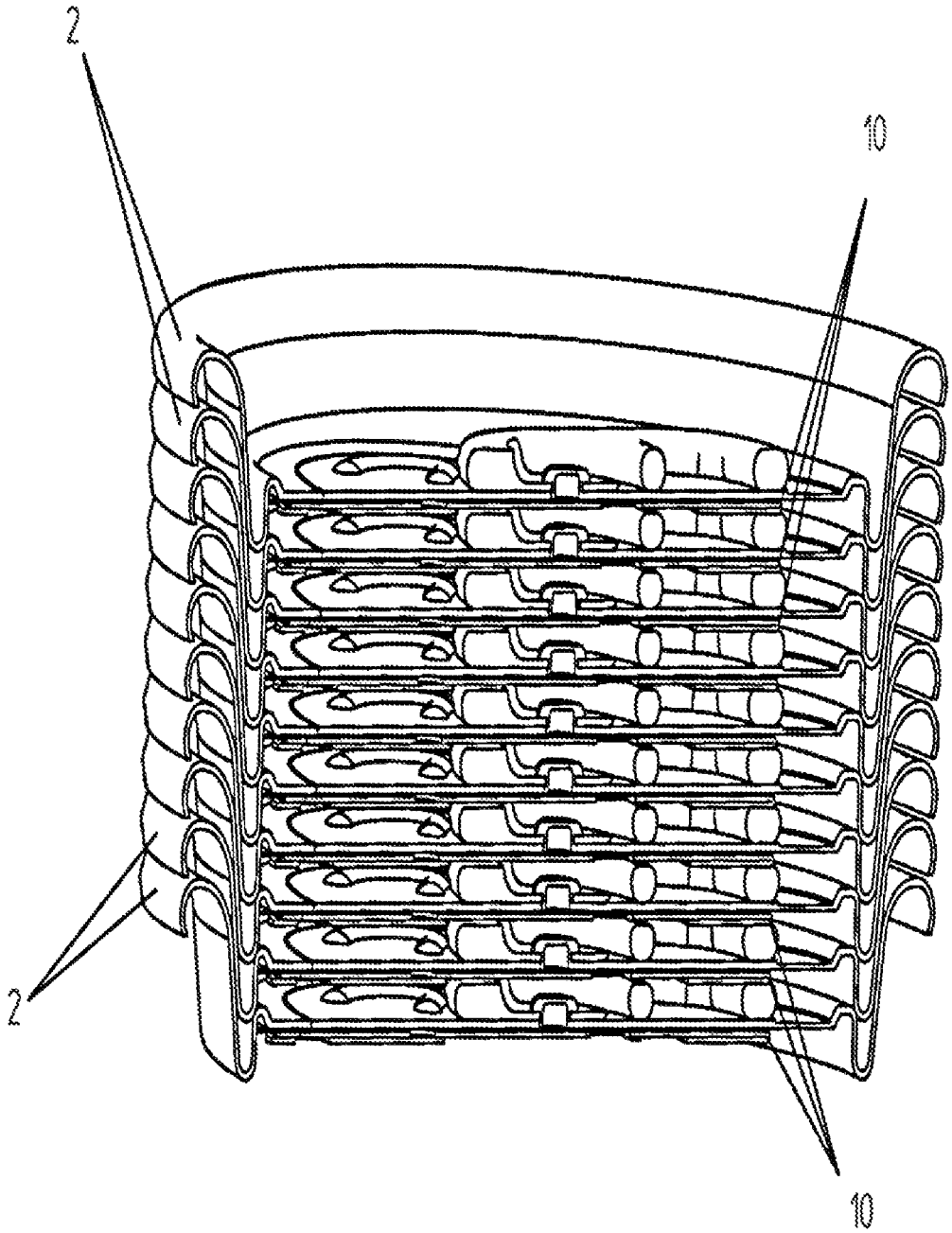
FIG. 26 shows a number of can ends according to one embodiment, stacked on top of each other.

FIG. 26 shows a stack of can ends 2 according to one embodiment of the invention. Each can end 2 comprises an elastic resilient element 10. The elastic resilient elements 10 in the can ends 2 have a small total thickness, that is preferably smaller than 2 mm, more preferably smaller than 1 mm, even more preferably smaller than 0.5 mm, so that the can ends can be stacked one on top of the other one, as shown in FIG. 26. The total thickness of an elastic resilient element 10 is the maximum dimension of the elastic resilient element in the direction perpendicular to the plane through the cap top 3 (see FIG. 3*a*) of can end 2, when the elastic resilient element 10 is mounted on the can end 2, as shown in FIG. 26, and as also shown e.g. in FIG. 3*a*. The stack of can ends 2 preferably requires only as much space as a stacked set of traditional can ends.

Figure 27:
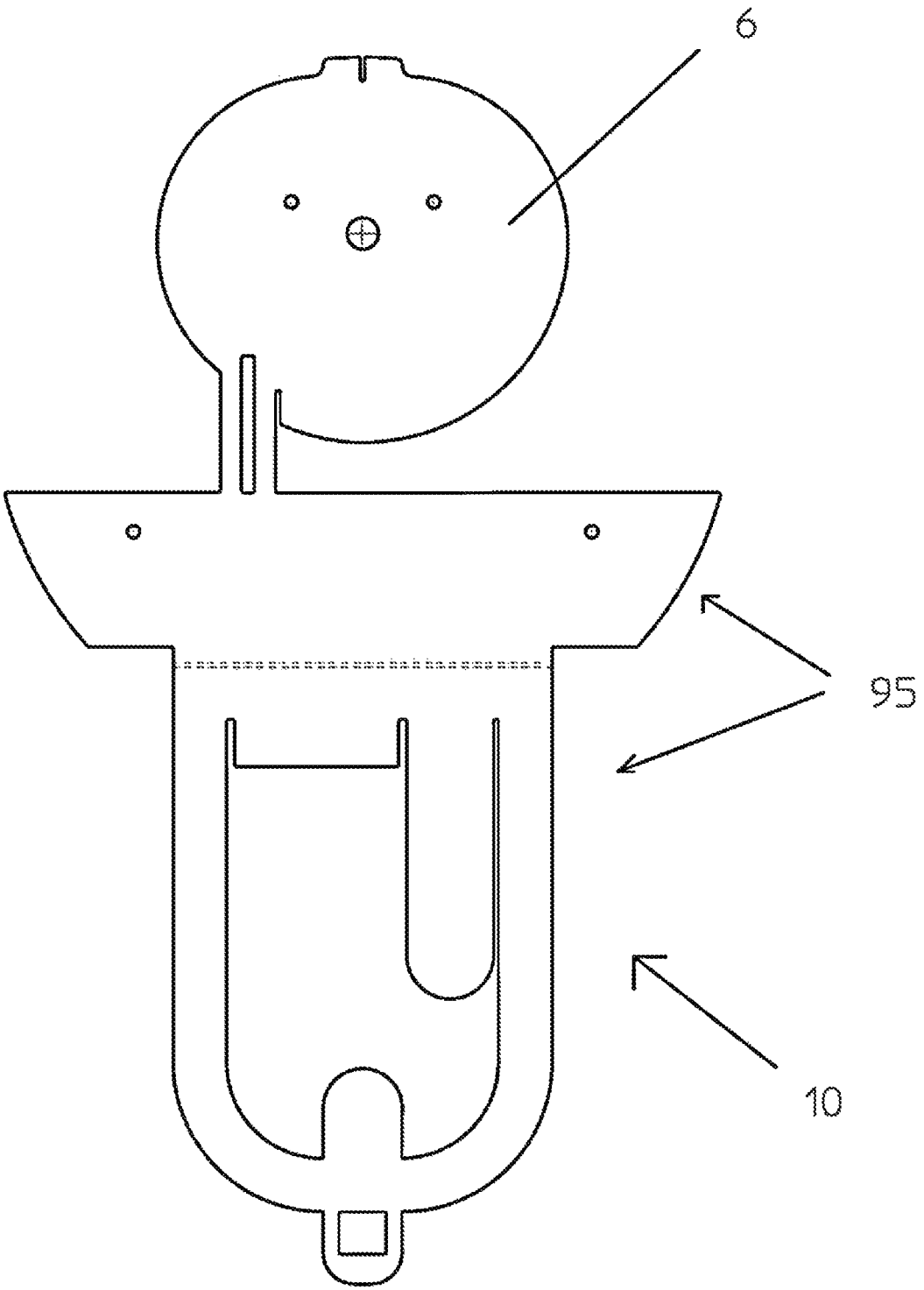
FIG. 27 shows an embodiment of an elastic resilient element, suitable for being used in stackable can ends as shown in FIG. 26.

FIG. 27 shows a top view of an embodiment of an elastic resilient element 10 in accordance with the invention, that may be used in the can ends 2 shown in FIG. 26. In FIG. 27, the elastic resilient element is not yet folded. Preferably, and similarly to the embodiments of elastic resilient elements discussed above, the elastic resilient element 10 comprises holding means, not shown in FIG. 27, for holding shut-off valve 6 in an opened position, as discussed above. In the shown embodiment the elastic resilient element comprises a plate spring means 95, made e.g. from steel. E.g. stainless austenitic steel 1.4310 C1300 may be used, having a thickness of 0.2 mm, or 0.15 mm, or 0.10 mm, or 0.05 mm. Other materials having good resilience properties and good plasticity (for folding, as discussed below), and other thicknesses, may be used as well.

Figure 28A:
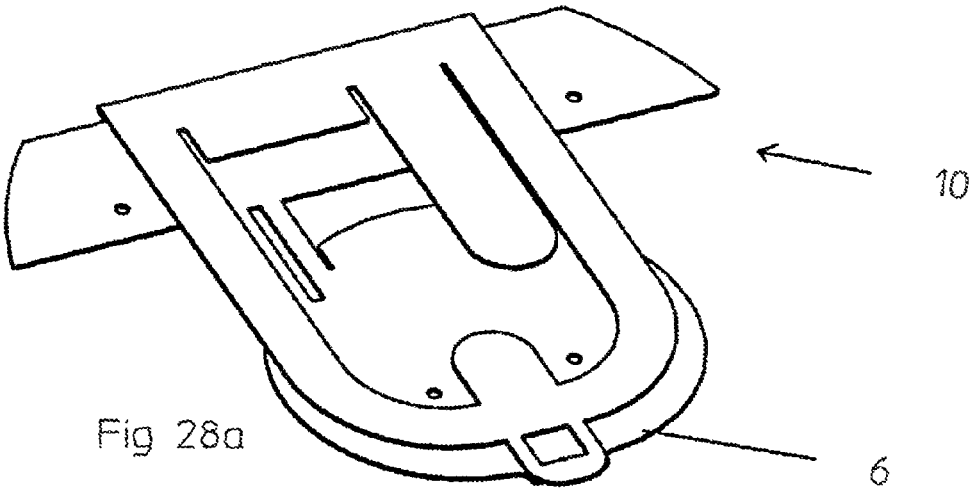
FIGS. 28*a* and 28*b* show a top view and a bottom view of the elastic resilient element of FIG. 27, in a folded state.
Figure 28B:
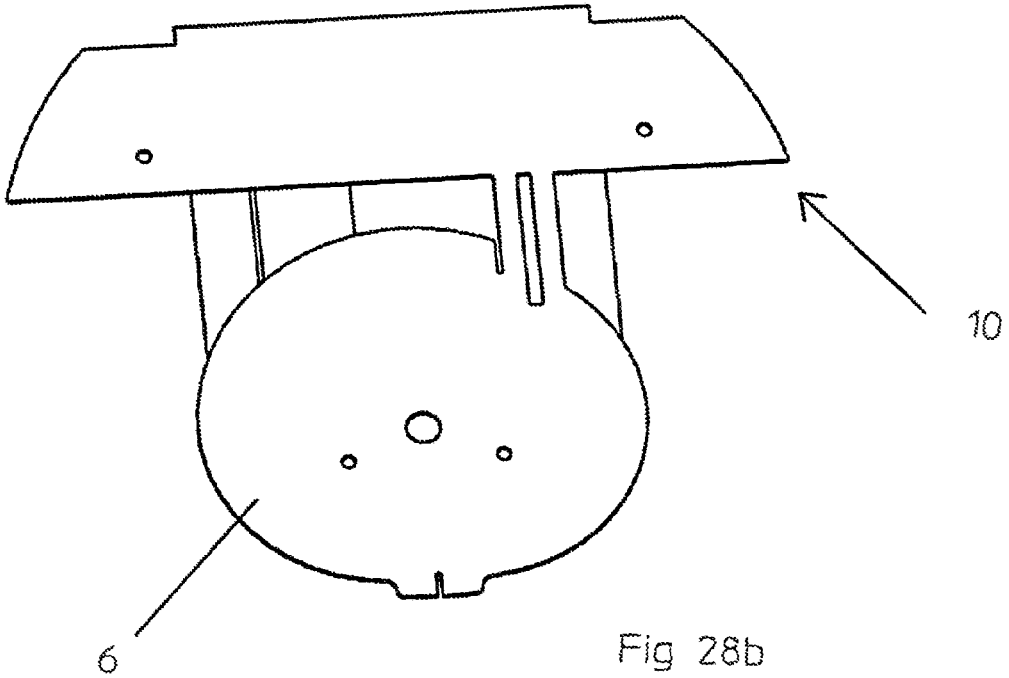

FIGS. 28*a* and 28*b* show a top and a bottom view of the elastic resilient element 10 of FIG. 27, when folded. In one embodiment, wherein steel 1.4310 C1300 having a thickness of 0.1 mm is used, the folded elastic resilient element has a total thickness of only about 0.2 mm, thanks to the good plasticity of the material.

In some embodiments of the invention, the pressure relief valve 8, which was discussed above with reference to FIGS. 10*a* and 10*b*, may be simplified. If e.g. an elastic resilient element as discussed with respect to FIGS. 28*a* and 28*b* is used, in some embodiments the bulging portion 25 of cap top 3 (see FIGS. 10*a* and 10*b*) may be very small, and hole 26 of shut-off valve 6 may be omitted. If the total thickness of the elastic resilient element 6 is small enough, e.g. approximately 0.2 mm, the bulging portion 25 may also be omitted. Thanks to the small resilient force of the elastic resilient element 10, when re-opening the can, the cap top moving downwards locally creates a small opening that relieves the pressure in the can.

Figure 29:
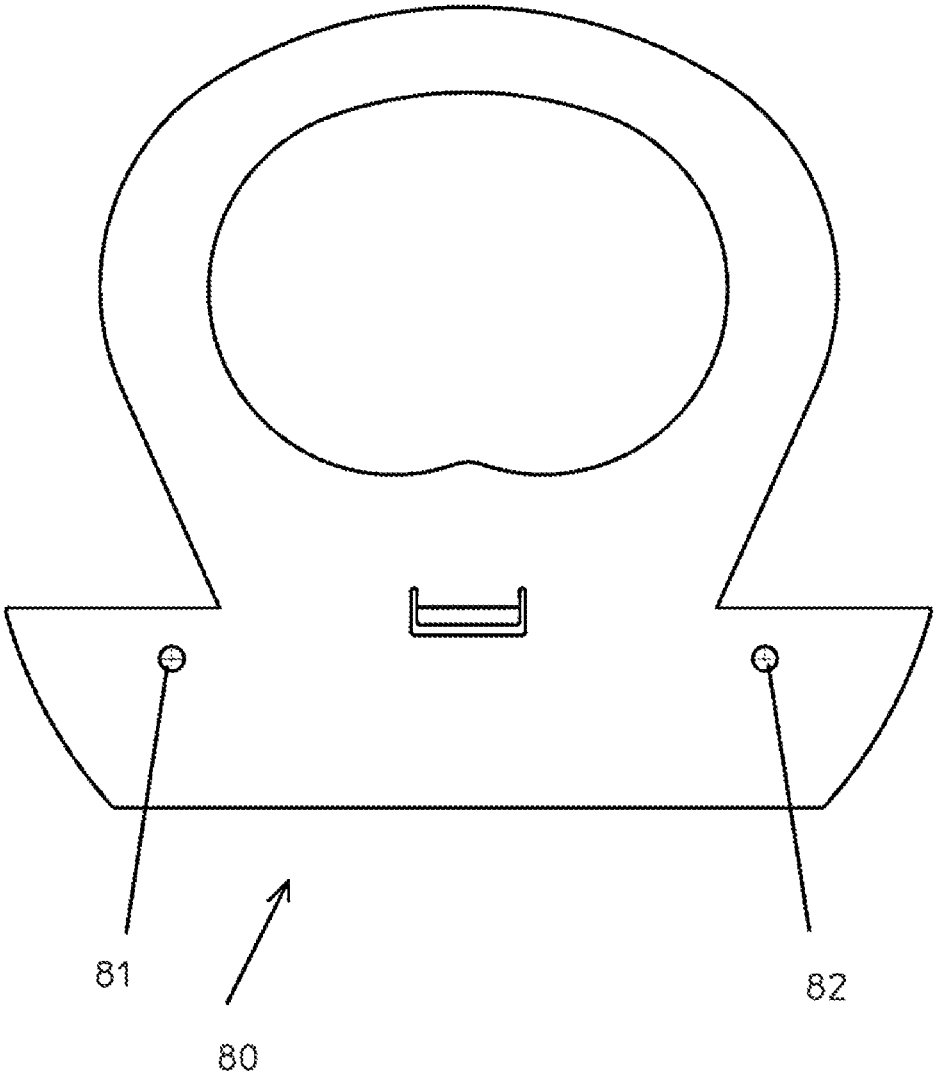
FIG. 29 shows an embodiment of an intermediate element.
Figure 30:
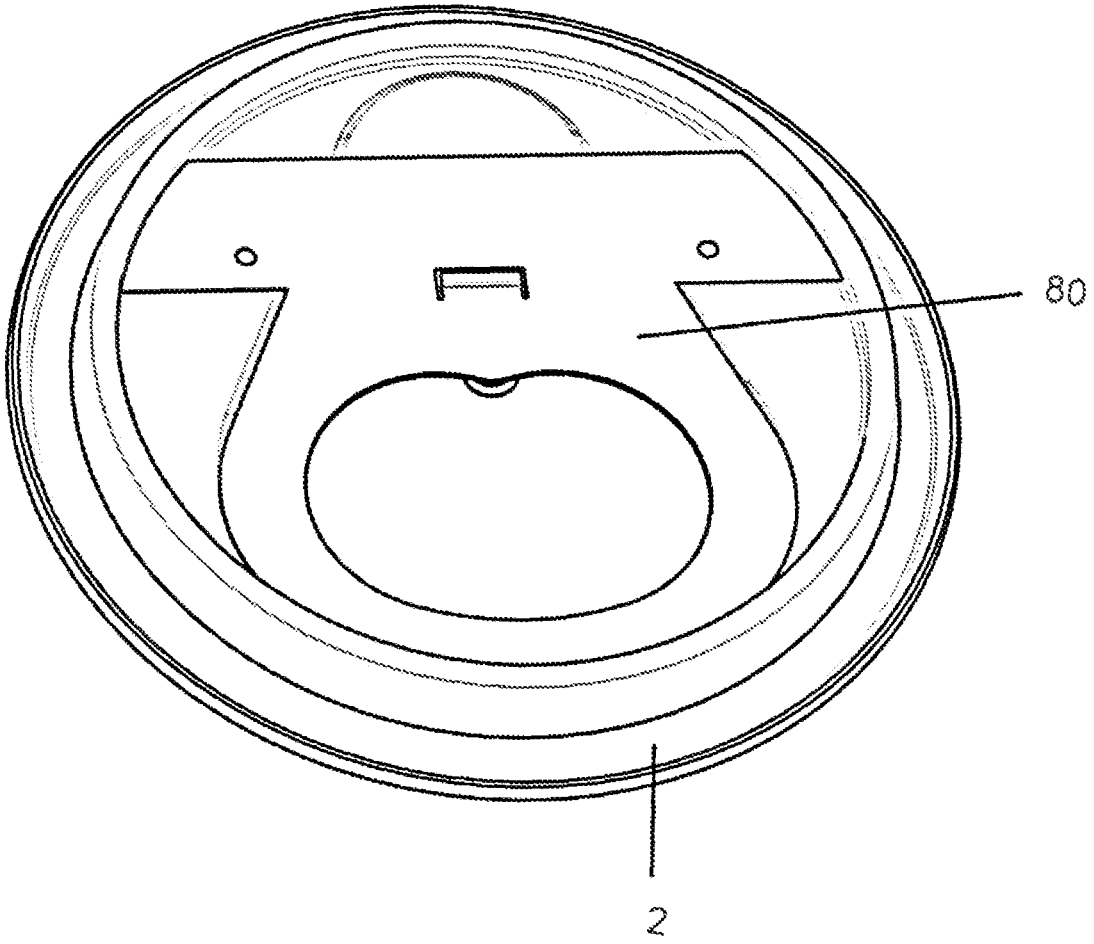
FIG. 30 shows the intermediate element of FIG. 29, mounted in a can end.
Figure 31:
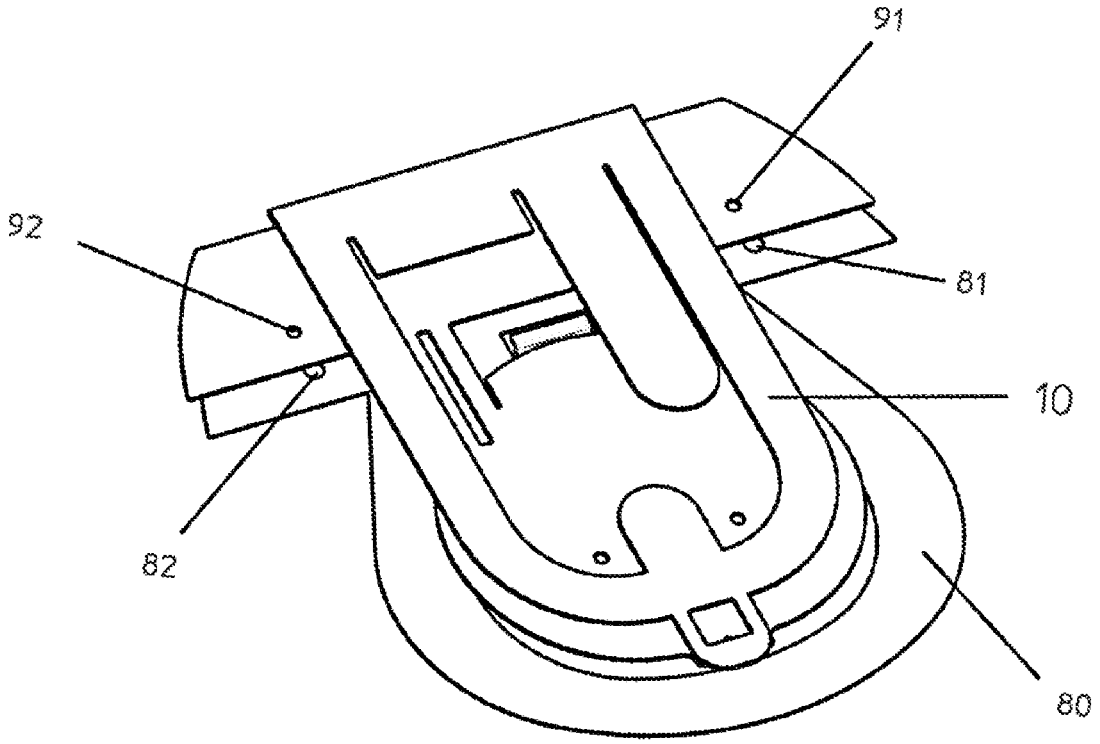
FIG. 31 shows the elastic resilient element shown in FIG. 28*a* being assembled to the intermediate element of FIG. 29.
Figure 32:
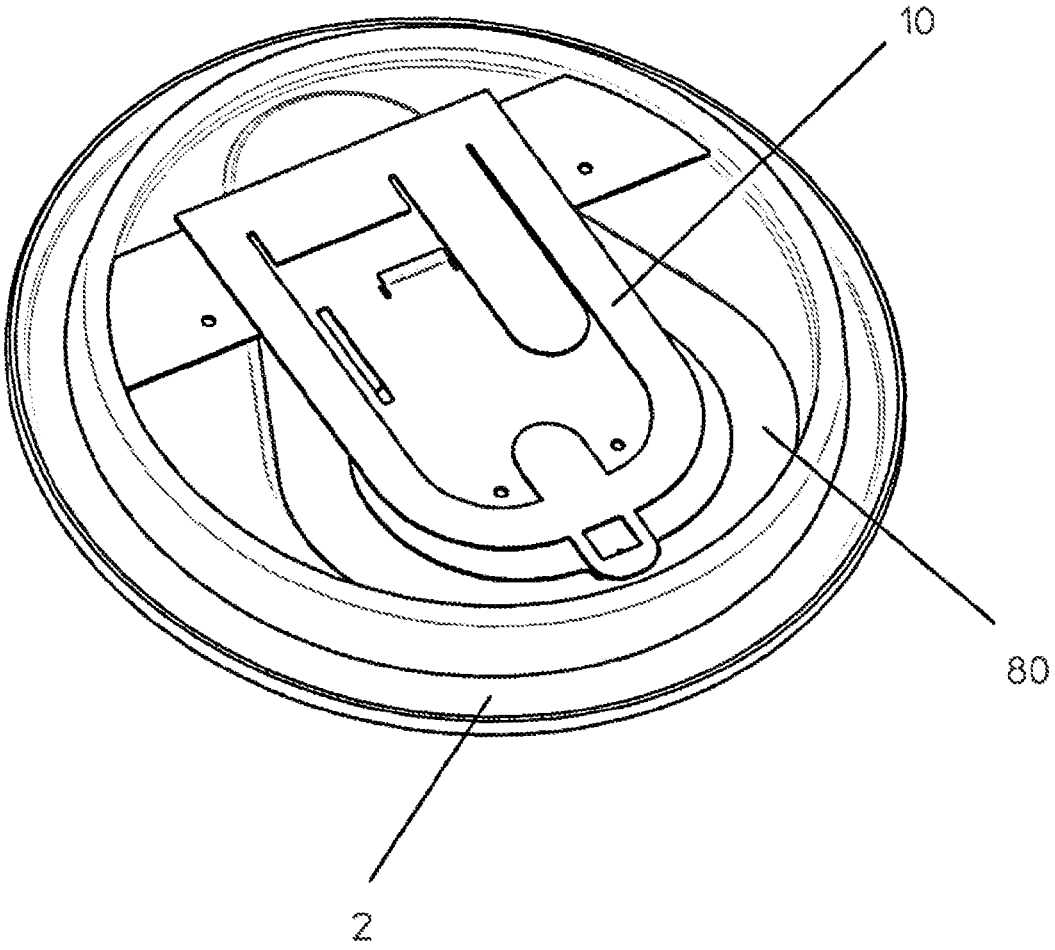
FIG. 32 shows the assembly illustrated by FIG. 31 of the elastic resilient element and the intermediate element, mounted in a can end.

FIG. 29 shows an embodiment of an intermediate element 80 as may be used in embodiments according to the invention. The intermediate element 80 may be positioned between an elastic resilient element 10 and a can end 2, and may be used to attach the elastic resilient element. FIG. 30 shows an embodiment of an intermediate element 80 attached to a can end 2. The intermediate element may e.g. be attached by means of an adhesive. FIG. 31 shows an elastic resilient element 10 being assembled to an intermediate element 80. Both elements may be riveted to each other, using a rivet through opening 81 of intermediate element 80 and opening 91 of elastic resilient element 10, and a rivet through opening 82 of intermediate element 80 and opening 92 of elastic resilient element 10. FIG. 32 shows an embodiment of an assembly of an elastic resilient element 10 and an intermediate element 80, mounted in a can end 2. For the intermediate element, e.g. a stainless steel having good elongation properties may be used. The intermediate element may have a thickness of e.g. 0.05 mm or 0.1 mm, but other thicknesses are possible as well. Using an intermediate element may have several advantages. The elastic resilient element may be riveted to the intermediate element, which may be attached to the can end by means of an adhesive, so that no rivets through the can end are required. The intermediate element may support the can end, and it may support the elastic resilient element as well. Further, using an intermediate element may offer more flexibility.

FIGS. 33 to 40 illustrate other embodiments of a can end in accordance with the invention, that include a raised lip-contact portion and that moreover can be stacked onto each other. These can ends comprise an elastic resilient element that preferably has a small total thickness, as discussed already above.

Figure 33A:
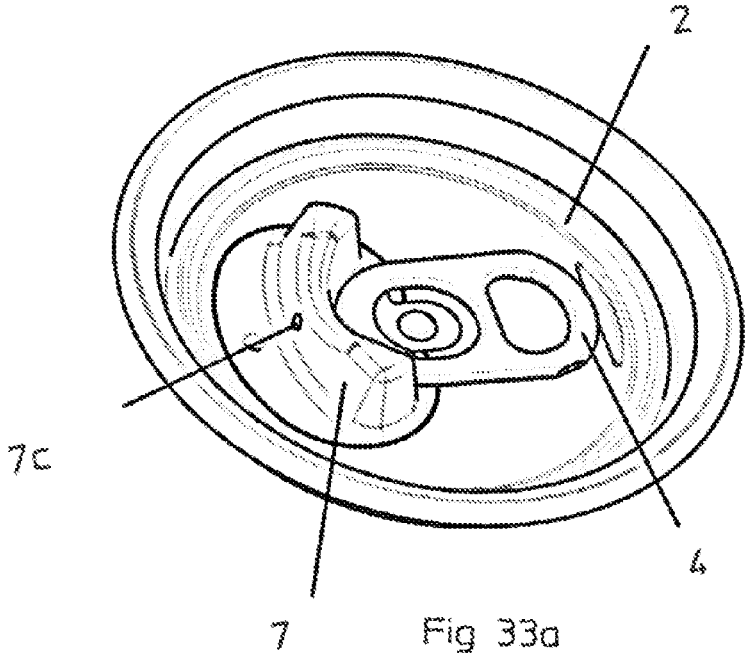
FIGS. 33*a* and 33*b* show 3D views of another embodiment of a can end, seen respectively from the top and from the bottom.
Figure 33B:
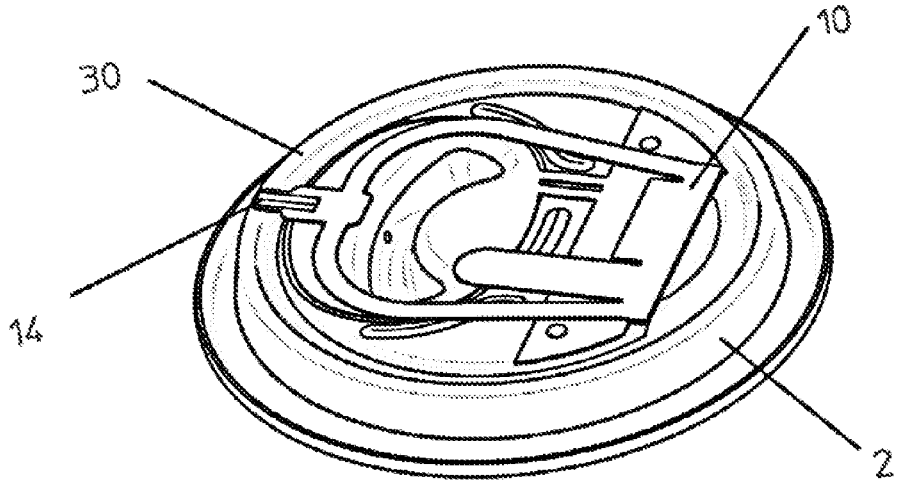

FIGS. 33*a* and 33*b* show a top view respectively a bottom view of such an embodiment of a can end 2 having a raised lip-contact portion 7. FIGS. 33*a* and 33*b* are similar to FIGS. 1*a* and 1*b* but now additionally show the raised lip-contact portion 7. A raised lip-contact portion 7*a* of the elastic resilient element 10 fits in the raised lip-contact portion 7 of the can end 2, as is discussed with reference to FIG. 35*b* further below; imprint 7*c* is used to clamp portion 7*a* in portion 7, as discussed below.

Holding means 32, as discussed with reference to FIGS. 1*a* and 1*b* may be present or, in other embodiments, is absent; in FIGS. 33 to 40 holding means 32 are not explicitly shown.

The elastic resilient element 10 shown in FIG. 33*b* has an extended portion 14 that extends underneath a rim 30 of the can end 2, in such a manner that a contact will occur between the extended portion 14 and the rim 30 when internal pressure deforms the can, e.g. due to high temperature, as discussed already above; extended portion 14 then acts as a security pressure relief, as discussed above.

Figure 34A:
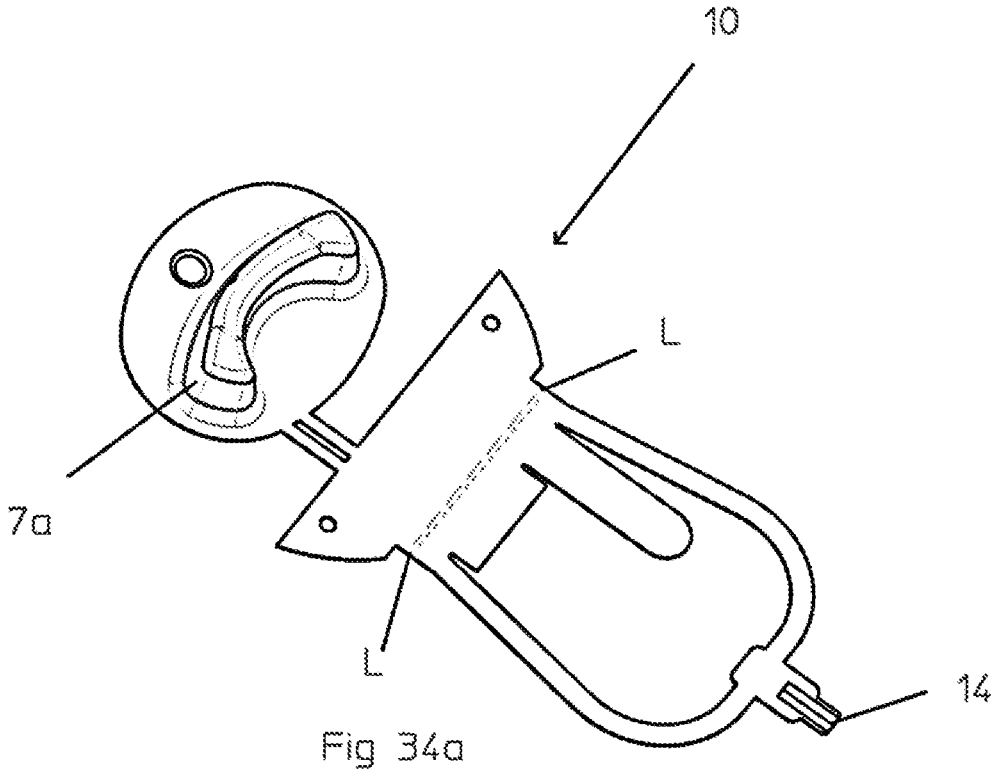
FIGS. 34*a* and 34*b* show an embodiment of an elastic resilient element used in the embodiment of FIGS. 33*a* and 33*b;*
Figure 34B:
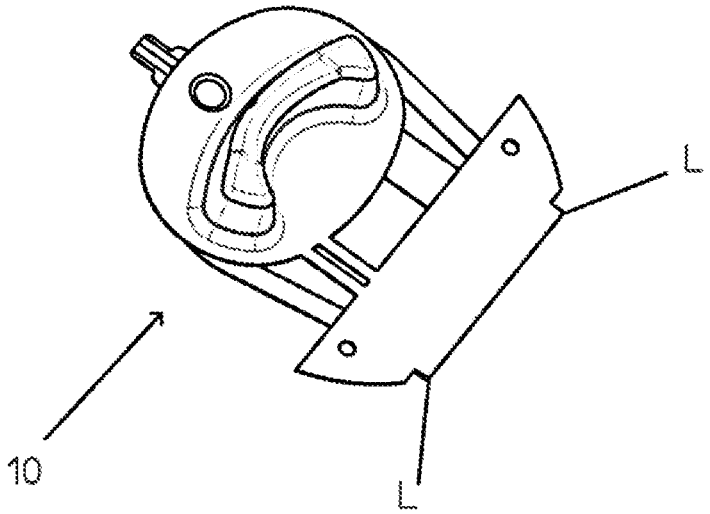

FIGS. 34*a* and 34*b* show an embodiment of an elastic resilient element 10 used in the embodiment of FIGS. 33*a* and 33*b*. FIG. 34*a* shows the elastic resilient element 10 before it is folded; FIG. 34*b* shows the elastic resilient element 10 after it is folded along folding line LL.

Figure 35A:
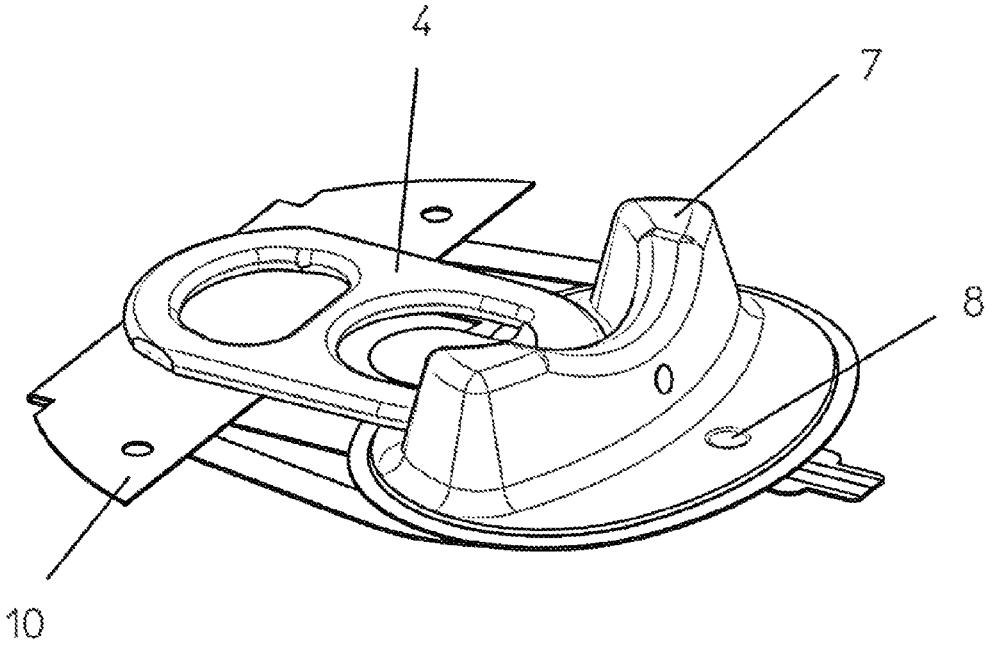
FIGS. 35*a* and 35*b* show an embodiment of an assembly including the elastic resilient element of FIGS. 34*a* and 34*b;*
Figure 35B:
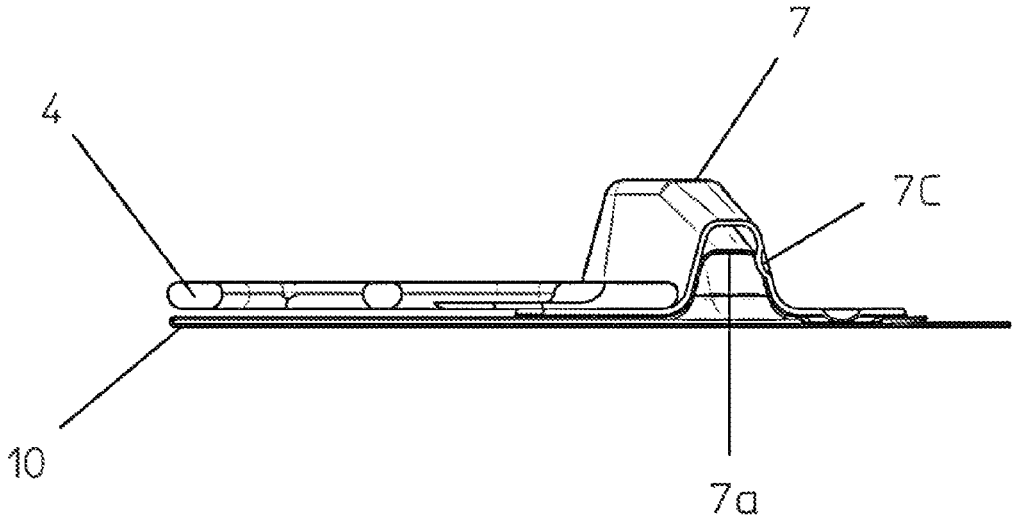

FIG. 35*a* shows a 3D view an embodiment of an assembly including the elastic resilient element 10 of FIGS. 34*a* and 34*b*, while FIG. 35*b* is a side view and cross section of this assembly. As can be seen in FIG. 35*b*, the raised lip-contact portion 7*a* of the elastic resilient element fits in a raised lip-contact portion 7 of the can end. Portion 7*a* is clamped in portion 7, by means of an imprint 7*c*, but the tolerances are such that both portions fit with a certain play, so that pressure relief valve 8 can function adequately. As discussed already above, a simplified version of the pressure relief valve may be used, if the total thickness of the elastic resilient element is small enough.

Figure 36A:
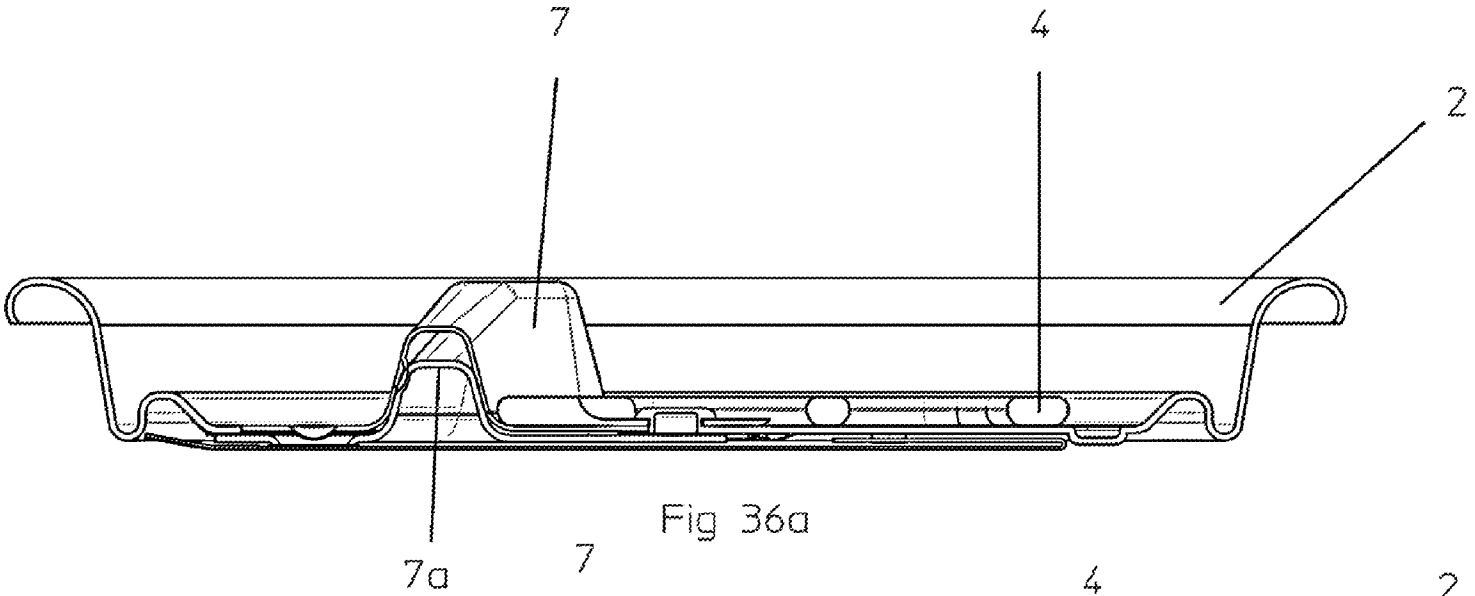
FIGS. 36*a* and 36*b* show cross sections of embodiments of can ends.
Figure 36B:
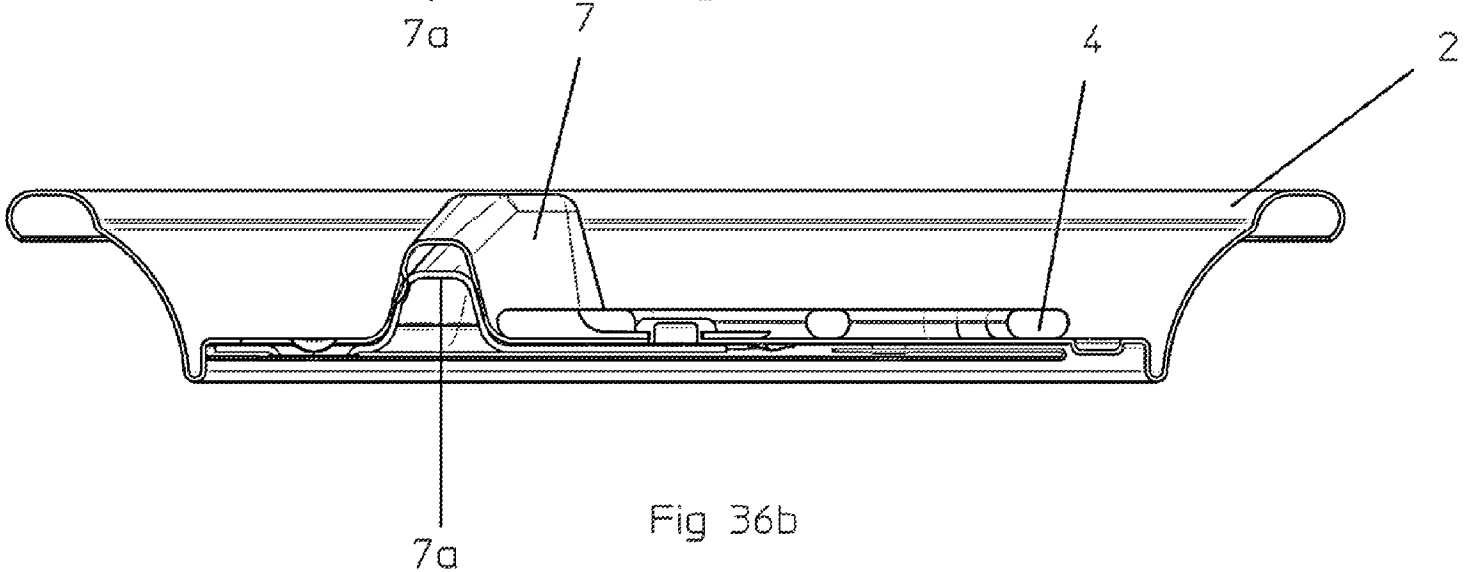

FIG. 36*a* shows a side view and cross section of an embodiment of the invention, discussed with reference to FIGS. 33 to 35, for a so called "Standard End" can end 2 from Crown, today Crown Holding Inc. Such a "Standard End" is customarily used nowadays. FIG. 36*b* shows a side view and cross section of an embodiment of the invention for a SuperEnd™ can end 2 from Crown Holding Inc, which is a new type of can end.

Figure 37:
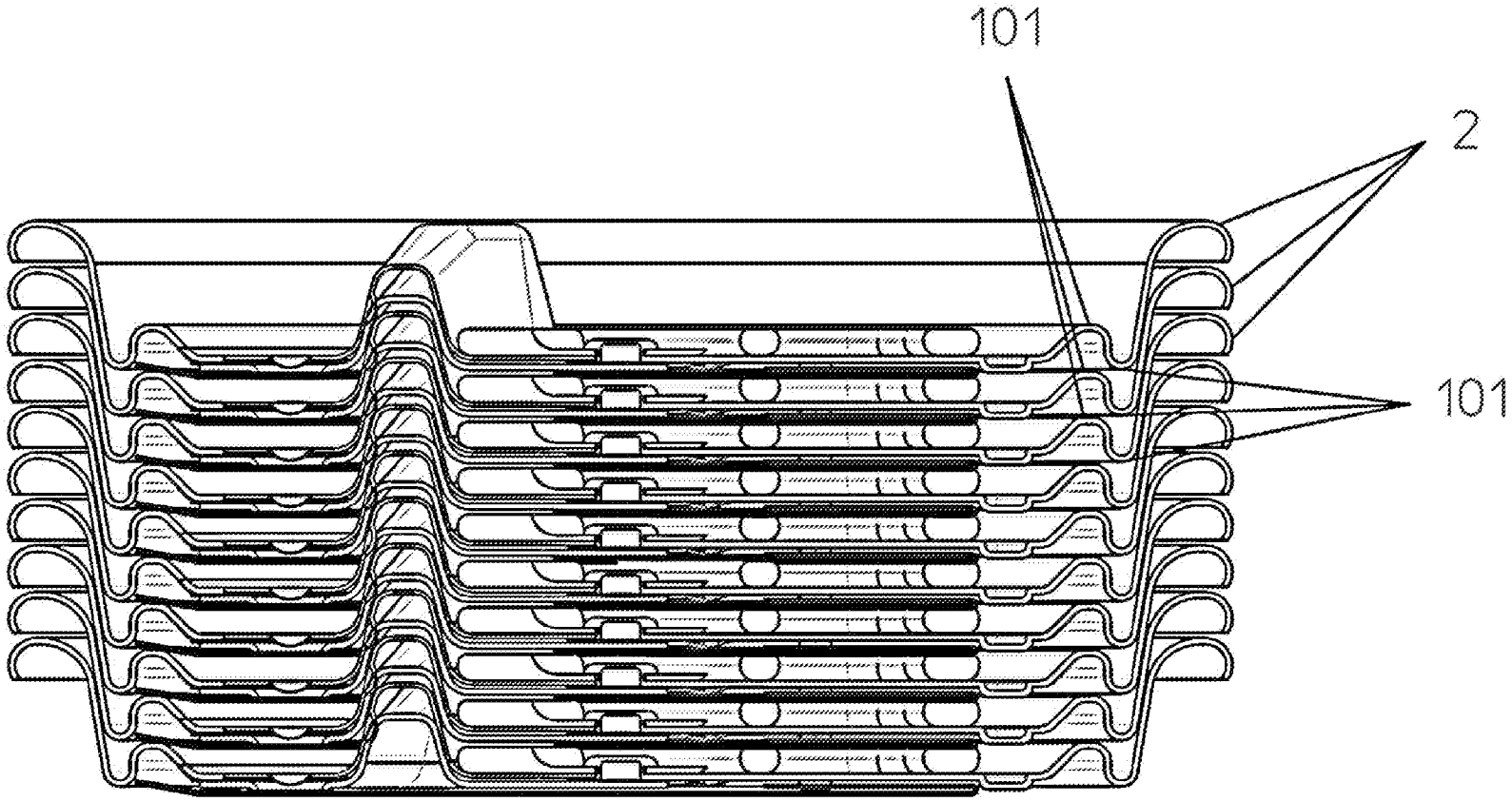
FIGS. 37 and 38 show stacks of embodiments of can ends.
Figure 38:
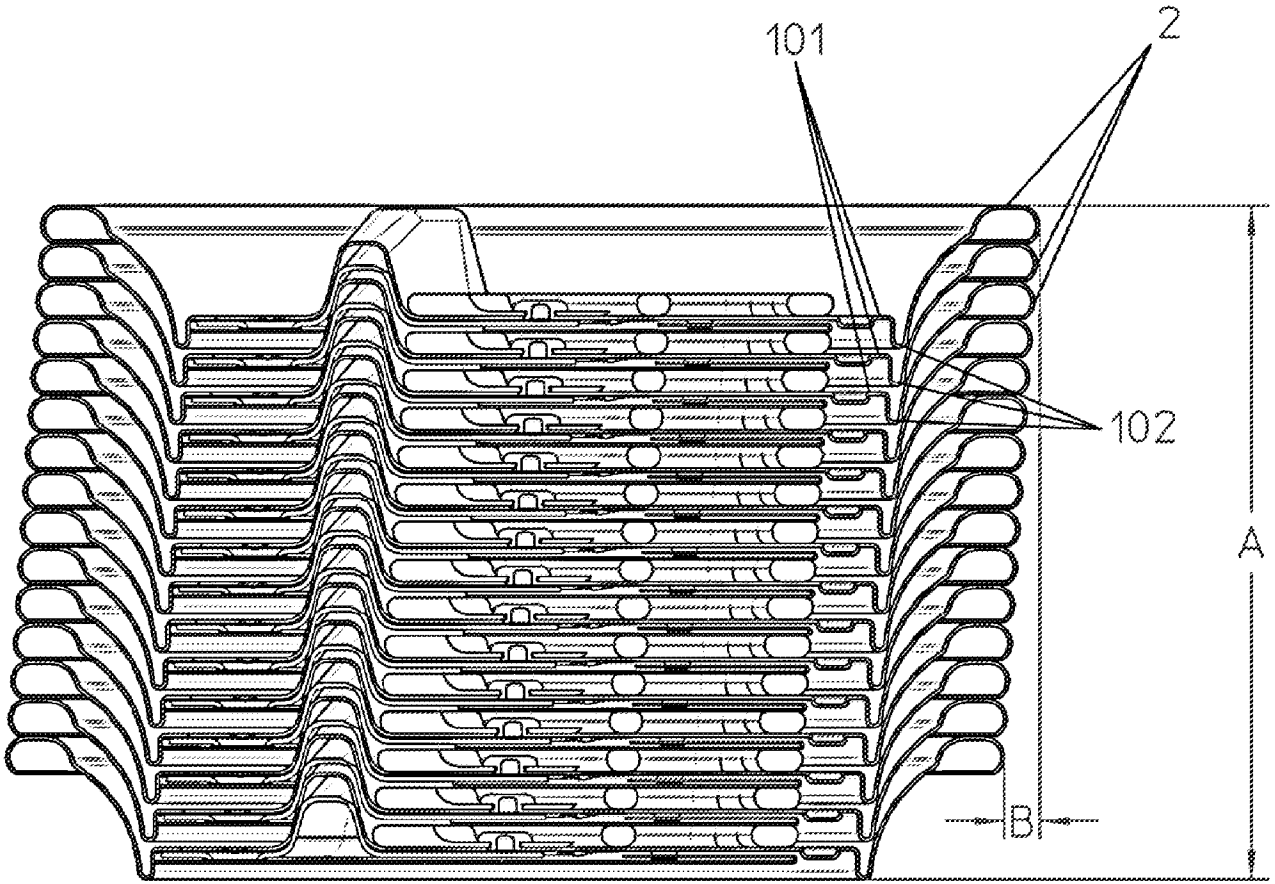

In some embodiments of the invention, the can ends 2 may be stacked one on top of the other, as discussed already above; the shape and dimensions of the can ends are then such that they may be stacked. FIG. 37 shows a stack of "Standard End" can ends 2 as shown in FIG. 36*a*, while FIG. 38 shows a stack of SuperEnd™ can ends 2; in both cases, each can end 2 has a first side 101 and a second side 102 opposite to the first side, wherein the second side 102 is adapted for receiving a first side 101 of another identical can end 2. One of the advantages of SuperEnd™ can ends 2 is that a stack of can ends 2 is not necessarily straight: as shown in FIG. 38, in a stack of can ends 2 having a height A, the uppermost can end may be translated over a distance B with respect to the lowermost can end. This fact may be used advantageously in the production phase, when stacks of can ends are transported.

Figure 39:
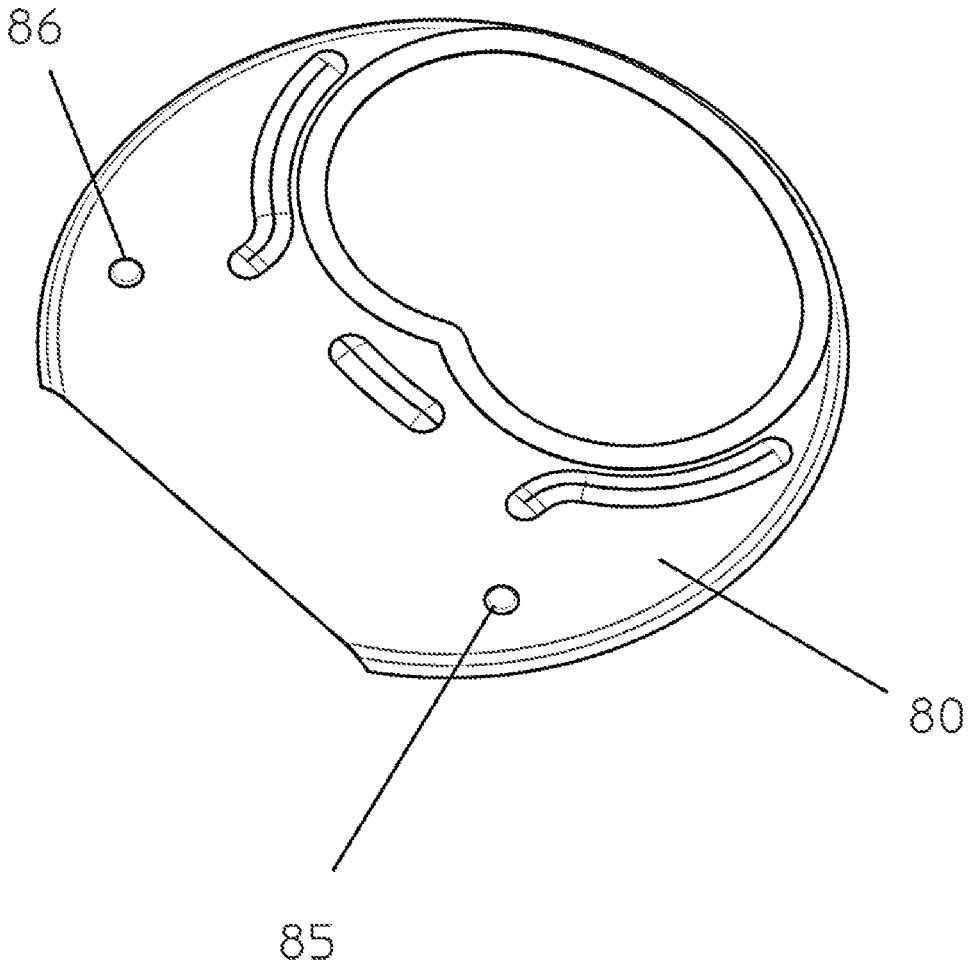
FIG. 39 shows an embodiment of an intermediate element.
Figure 40:
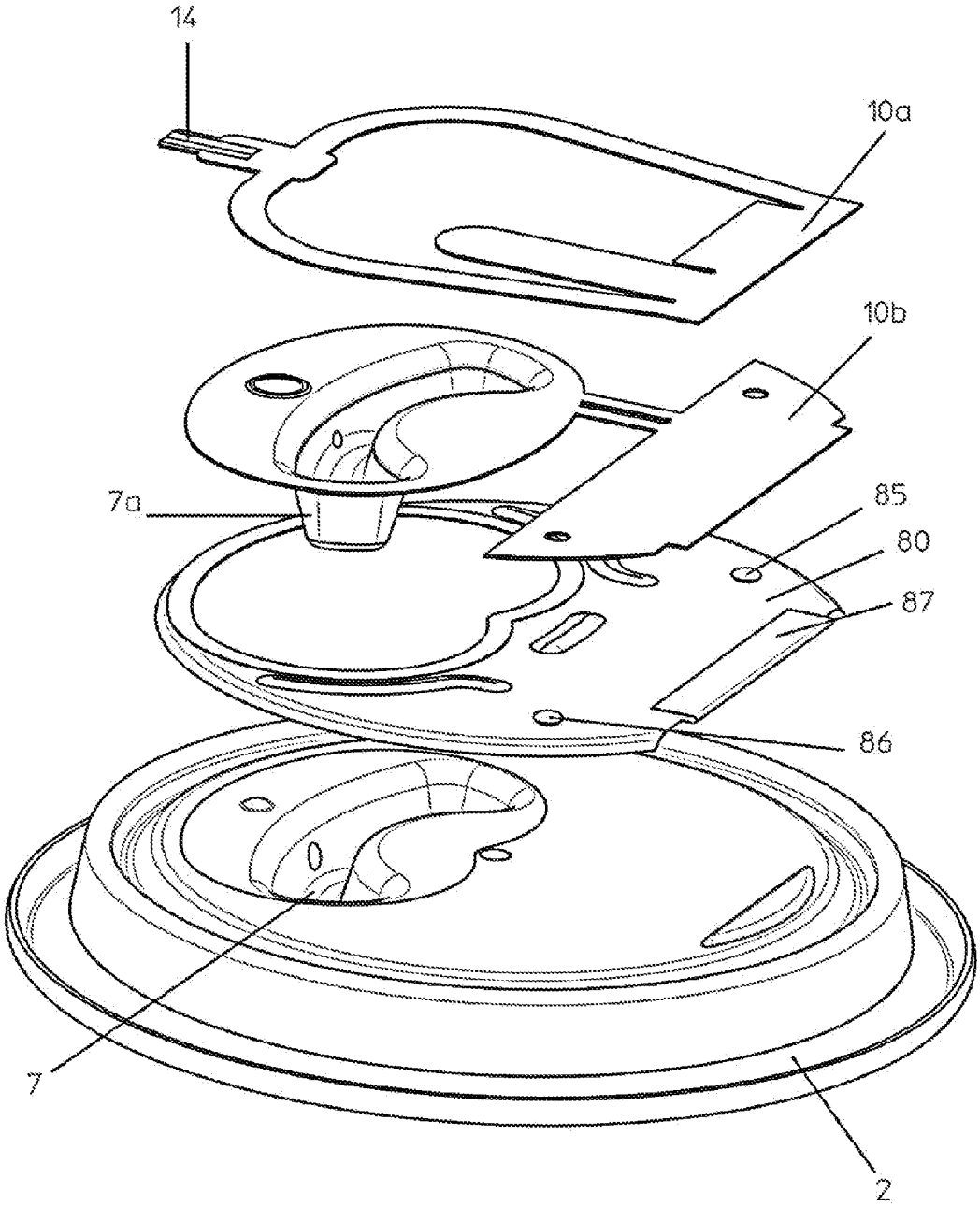
FIG. 40 shows an exploded view of an assembly including the intermediate element of FIG. 39.

FIG. 39 shows an embodiment of an intermediate element 80, as discussed already above, that may be used with the embodiment of the resilient element 10 shown in FIGS. 33 to 38, while FIG. 40 shows an exploded view of an assembly including this intermediate element 80. In the embodiment of FIG. 40, the elastic resilient element 10 comprises two different parts, part 10*a* and part 10*b*. The two parts are as shown in the elastic resilient element 10 of FIG. 34*a*, when this single element is cut along folding line LL.

An advantage of having an elastic resilient element of two parts is that the two parts may be made from different materials. Part 10*b*, that contains the raised lip-contact portion 7*a*, may be made e.g. from a steel allowing a high plastic deformation, while part 10*a* may e.g. be made from a stainless austenitic steel as discussed already above.

Intermediate element 80 may contain two nipples 85, 86 and/or a fold 87. The intermediate element 80 may be attached to can end 2 by an adhesive. In one embodiment, wherein an elastic resilient element 10 out of a single piece is used, it may be attached to the intermediate element 80 via nipples 85 and 86.

In another embodiment, wherein an elastic resilient element 10 having two parts 10*a* and 10*b* is used, both parts 10*a* and 10*b* may be clamped to the intermediate element 80 via fold 87.

The present invention is not limited to the embodiments described above. The scope of the present invention is defined by the appended claims.

The invention claimed is:

1. A can end for a metal beverage can, said can end comprising:

a cap top, arranged with a connection to a pull tab configured to remove said cap top from a top portion of said can end along a pre-defined groove on the top portion, to thereby create a drinking or pouring aperture;

an elastic resilient element attached to the can end; and a resiliently operated shut-off valve that is part of or is connected to said elastic resilient element and that is configured to close and seal the drinking or pouring aperture after drinking or pouring, by an action of said elastic resilient element;

wherein said cap top is configured to remain located, after said removal, on top of said shut-off valve, and wherein said elastic resilient element has a holding element configured to hold said shut-off valve in an opened position upon moving said cap top.

2. The can end according to claim 1, wherein said holding element is configured to hold said shut-off valve in said opened position upon moving said cap top by said pull tab.

3. The can end according to claim 1, wherein said cap top has an upper surface and comprises a raised lip-contact portion on said upper surface.

4. The can end according to claim 1, wherein said shut-off valve comprises a relief valve, actuatable by interaction with said cap top and configured to release gas pressure from inside the can upon the first pressure being exerted on said relief valve.

5. The can end according to claim 1, wherein said holding element is configured to release said shut-off valve, when in said opened position, so as to close and seal said drinking or pouring aperture, by upsetting or dropping a can comprising said can end.

6. The can end according to claim 1, wherein said holding element is configured to release said shut-off valve, when in said opened position, so as to close and seal said drinking or pouring aperture, by exertion of a force on an element selected from the group consisting of said elastic resilient element, said shut-off valve, and said cap top.

7. The can end according to claim 1, wherein said shut-off valve comprises a first engaging element and wherein said holding element comprises a second engaging element configured to engage said first engaging element.

8. The can end according to claim 1, wherein said shut-off valve has a circumference and comprising a seal around said circumference.

9. The can end according to claim 1, further comprising an intermediate element between said elastic resilient element and said top portion of said can end.

10. The can end according to claim 1, wherein said can end has a first side and a second side opposite to said first side, wherein said second side is configured to receive a first side of an identical can end for forming a stack of can ends.

11. A metal beverage can, comprising a can body and the can end recited in claim 1.

12. A method for producing a metal beverage can comprising a can body and a can end, the method comprising:

producing the can end for the metal beverage can, said can end comprising: a cap top, arranged with a connection to a pull tab configured to remove said cap top from said can end along a pre-defined groove, to thereby create a drinking or pouring aperture;

an elastic resilient element attached to the can end; and a resiliently operated shut-off valve that is part of or is connected to said elastic resilient element and that is configured to close and seal the drinking or pouring aperture after drinking or pouring, by an action of said elastic resilient element; wherein said cap top is configured to remain located, after said removal, on top of said shut-off valve and wherein said elastic resilient element has a holding element configured to hold said shut-off valve in an opened position upon moving said cap top;

producing the can body;

attaching the can end to the can body.

13. A method for using a reclosing metal beverage can, said can comprising a can body and a can end, the method comprising:

actuating a pull tab of said can end, thus removing a cap top of said can end along a predetermined groove of said can end, thus creating a drinking or pouring aperture;

resiliently opening, by said actuating of said pull tab, a shut-off valve that is connected to an elastic resilient element of said can end and that is configured to close and seal said drinking or pouring aperture after drinking or pouring, by an action of said elastic resilient element, wherein said removed cap top remains located on top of said shut-off valve; and holding said shut-off valve in an opened position by said elastic resilient element.

14. The method according to claim 13, comprising engaging a first element of said shut-off valve with a second element of said elastic resilient element, thus holding said shut-off valve in said opened position.

15. The method according to claim 13, comprising exerting a force on said elastic resilient element or on said shut-off valve or on both said elastic resilient element and said shut-off valve, when said shut-off valve is in said opened position, thus releasing said shut-off valve from said elastic resilient element and thus closing said drinking or pouring aperture.

16. The method according to claim 15, wherein said exerting of said force comprises tapping against said can, thus releasing said shut-off valve from said elastic resilient element and thus closing said drinking or pouring aperture.

* * * * *